US005377466A

United States Patent [19]

Insalaco et al.

[11] Patent Number: 5,377,466

[45] Date of Patent: Jan. 3, 1995

[54] SEPARABLE POST/PANEL SYSTEM

[75] Inventors: Robert W. Insalaco; Richard G. Haworth, both of Holland, Mich.

[73] Assignee: Haworth, Inc., Holland, Mich.

[21] Appl. No.: 891,557

[22] Filed: May 29, 1992

[51] Int. Cl.[6] ..... E04H 1/00

[52] U.S. Cl. ..... 52/238.1; 52/239; 160/135; 160/351

[58] Field of Search ..... 52/238.1, 239; 160/135, 160/351

[56] References Cited

U.S. PATENT DOCUMENTS

| | | | |
|---|---|---|---|
| Re. 32,890 | 3/1989 | DeFouw et al. . | |
| 2,142,005 | 12/1938 | Roberts . | |
| 2,175,717 | 10/1939 | Kerr . | |
| 3,101,817 | 8/1963 | Radek . | |
| 3,229,435 | 1/1966 | Olsen . | |
| 3,312,025 | 4/1967 | Deakins . | |
| 3,327,440 | 6/1967 | Watkins . | |
| 3,349,535 | 10/1967 | Balinski . | |
| 3,797,184 | 3/1974 | Thompson . | |
| 4,185,422 | 1/1980 | Radek . | |
| 4,250,676 | 2/1981 | Presby . | |
| 4,269,005 | 5/1981 | Timmons . | |
| 4,296,579 | 10/1981 | Proud . | |
| 4,334,374 | 6/1982 | Spamer et al. . | |
| 4,438,614 | 3/1984 | Raith | 52/580 |
| 4,446,669 | 5/1984 | Siegal | 52/738 |
| 4,497,148 | 2/1985 | Lopez | 52/126.3 |
| 4,545,168 | 10/1985 | Dalton | 52/588 |
| 4,567,698 | 2/1986 | Morrison . | |
| 4,593,508 | 6/1986 | Curatolo . | |
| 4,601,137 | 7/1986 | Bates . | |
| 4,716,692 | 1/1988 | Harper et al. . | |
| 4,716,699 | 1/1988 | Crossman et al. . | |
| 4,860,812 | 8/1989 | DePietro et al. . | |
| 4,907,384 | 3/1990 | Underwood . | |
| 4,914,878 | 4/1990 | Tamaki et al. . | |
| 4,928,465 | 5/1990 | Del Castillo Von Haucke . | |
| 4,993,205 | 2/1991 | Dull | 52/839 X |
| 4,996,811 | 3/1991 | Dull et al. . | |
| 5,003,740 | 4/1991 | Dull et al. . | |
| 5,005,325 | 4/1991 | Dull et al. . | |
| 5,033,526 | 7/1991 | DeLong et al. . | |
| 5,054,255 | 10/1991 | Maninfior . | |
| 5,056,285 | 10/1991 | Frascaroli et al. . | |
| 5,092,385 | 3/1992 | Beaulieu | 160/135 |
| 5,097,643 | 3/1992 | Wittler | 160/135 |

FOREIGN PATENT DOCUMENTS

| | | |
|---|---|---|
| 0133269A3 | 2/1985 | European Pat. Off. . |
| 0375641A1 | 6/1990 | European Pat. Off. . |

*Primary Examiner*—Carl D. Friedman
*Assistant Examiner*—Beth A. Aubrey
*Attorney, Agent, or Firm*—Flynn, Thiel, Boutell & Tanis

[57] ABSTRACT

A space-dividing upright wall system wherein wall panels are supported on and connected through upright panel connecting members, the latter having a foot for engagement with a floor. The panel connecting member is preferably of Z-shaped cross section including parallel side legs joined by a diagonally-extending cross wall. Each side leg has an upright row of slots which accommodate hangers associated with components which mount on the wall system. The slots in the two sidewalls are isolated from one another by the cross wall. Each side leg has vertically-extending rows of hooks projecting outwardly from opposite side edges thereof, which hooks cooperate with a pair of generally aligned panels for rigidly joining the panels together. When two adjacent panel assemblies are disposed in generally perpendicular relationship to one another, then the adjacent end edges are each provided with a connecting member secured thereto, and the adjacent pair of connecting members in turn are directly joined together through an intermediate corner connector which engages a row of hooks on the connecting member which is not engaged with the panel assembly.

24 Claims, 14 Drawing Sheets

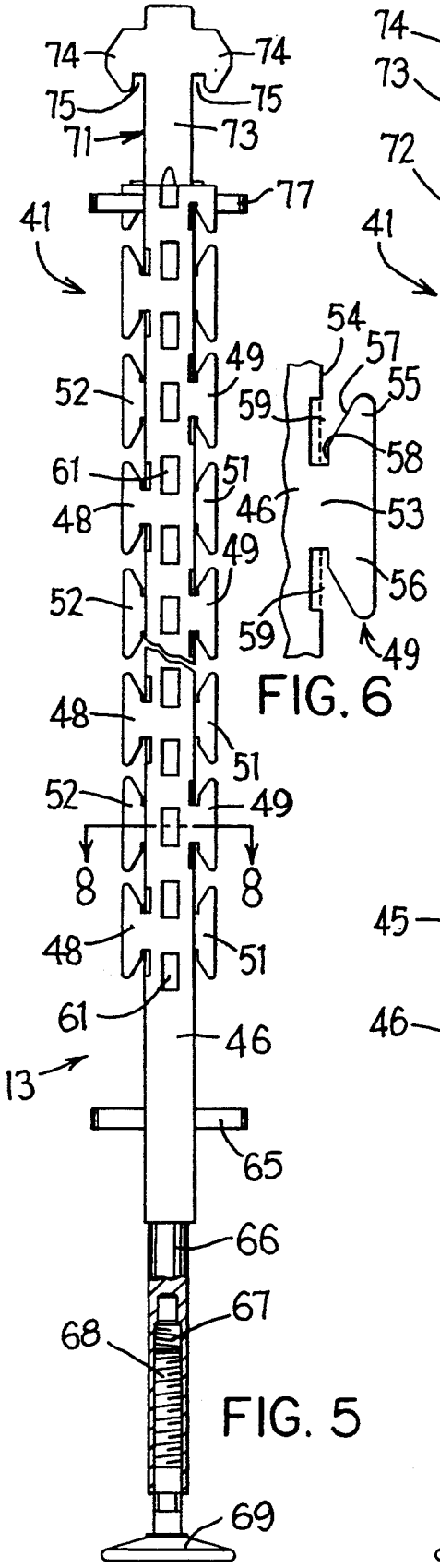
FIG. 5
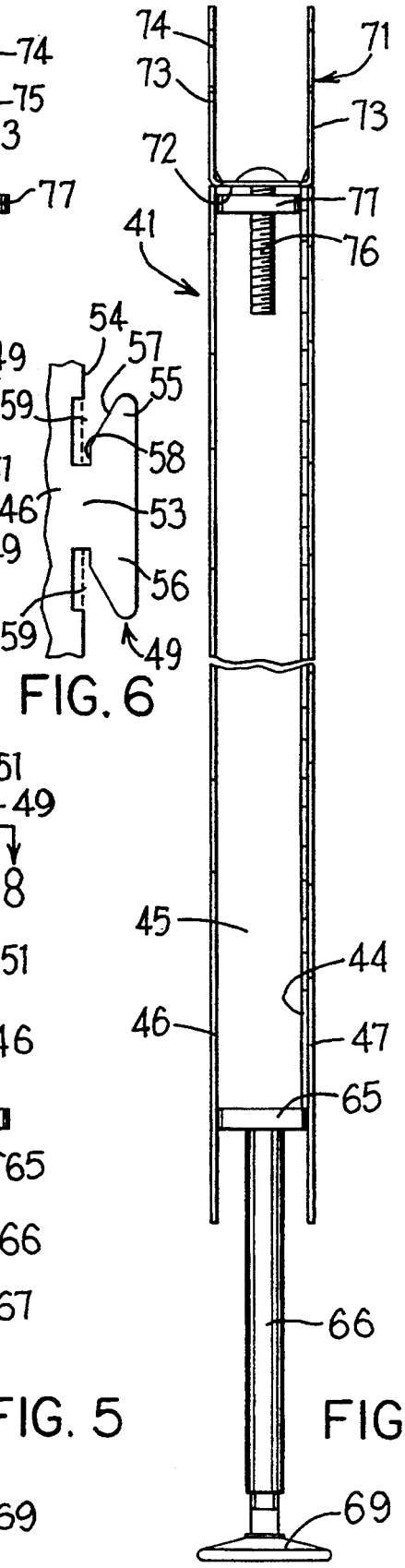
FIG. 6
FIG. 7
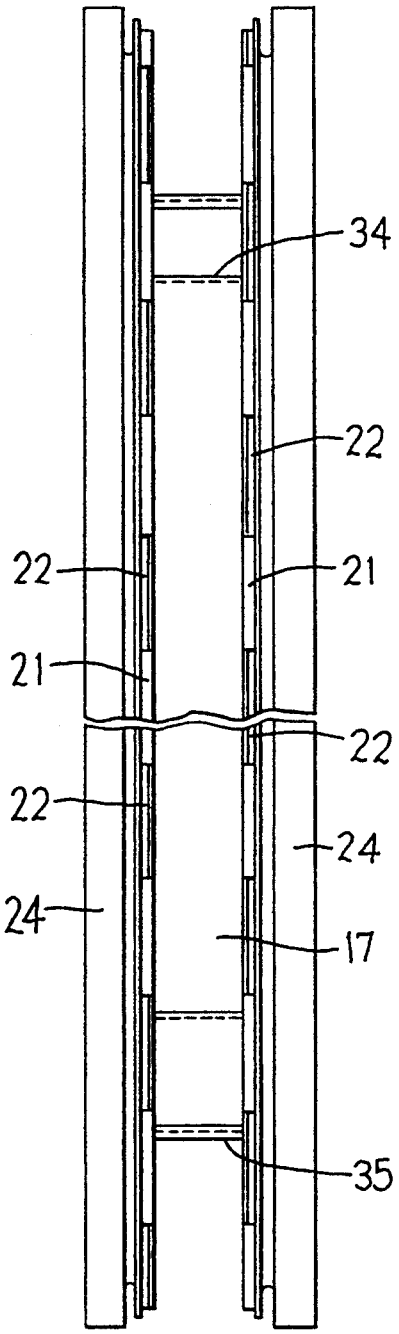
FIG. 4

SEPARABLE POST/PANEL SYSTEM

FIELD OF THE INVENTION

This invention relates to improvements with respect to an upright space-dividing wall system formed from serially connected panels and, more specifically, to an improved arrangement employing separate panel assemblies joined together by intermediate panel connectors.

BACKGROUND OF THE INVENTION

Numerous panel systems have been developed for use in dividing large open office areas into smaller work spaces or workstations, which panel arrangements typically employ upright space-dividing panels which are serially joined together to define smaller workstations of desired size and configuration. In the known arrangements, the individual panel assemblies have many different constructional features. For example, in some arrangements the individual panels are provided with individual support feet or glides which support the weight of the panel on the floor, and adjacent panels are then joined together through intermediate connectors, such as flexible hinges or connector plates, which connectors are not intended to be disposed in load-bearing relationship with the floor. In other arrangements, the adjacent panel assemblies are interconnected through intermediate upright support posts or poles, with the weight of the panels being transferred to the poles, which poles in turn are maintained in load-bearing engagement with the floor. Both types of arrangements are in common usage, and the present invention is concerned with improvements in panel arrangements of the latter-mentioned type.

More specifically, in many of the post-type panel arrangements, the intermediate post comprises an upright support tube, often of cylindrical configuration, which tube is provided with appropriate support flanges or grooves which engage cooperating parts on the adjacent panels for providing operative structural and supportive connection of the panels to the support posts. These cooperating support flanges and grooves are typically provided only adjacent the upper and lower ends of the support tube, and this hence restricts or complicates the flexibility of the system, particularly when adjacent panels are of different heights. In addition, in many of these systems the support post is a structural element which is of significant size, and in some cases the post is dimensioned so that it substantially corresponds in width to the width of the adjacent panel assemblies, and hence the post itself is a visible member and thus must be designed to blend in with the visible side surfaces of the wall system. This, however, restricts the aesthetics of the system. Further, many of these known systems have provided a connecting arrangement between the panel assembly and post which can be difficult to assemble, or which does not facilitate and/or adapt to use of a common post at all types of connections, such as not only at a conventional in-line two-panel connection, but also at a two-panel corner connection, a three-panel connection, a four-panel connection, and a free end panel support.

Many of the known panel arrangements of this general type have also involved expensive and complex manufacturing techniques, and hence have resulted in the panel arrangement being of greater expense than desired.

Accordingly, it is an object of this invention to provide an improved space-dividing wall arrangement, specifically a wall arrangement of the type wherein panel assemblies at opposite vertical ends are joined to and supported on load-supporting postlike connecting elements, which arrangement is desirable in that it is economical to manufacture, and permits the postlike connectors to be disposed substantially wholly internally between connected aligned panels so as to provide highly improved wall system aesthetics.

In the improved space-dividing upright wall system of the present invention, the wall panel assemblies are adapted to be supported on and connected through upright panel connecting members, the latter having a foot structure disposed for load-bearing engagement with a support surface such as a floor. The upright panel connecting member is preferably of a generally Z-shaped cross section including generally parallel side legs joined by a generally diagonally-extending cross wall. Each of the side legs has an upright row of slots therethrough which accommodate hangers associated with components which mount on the wall system. The slots in the two sidewalls are effectively isolated from one another to minimize noise transmission due to the diagonally-extending cross wall. Each side leg has vertically-extending rows of hooks projecting outwardly from opposite side edges thereof, which hooks cooperate with a pair of generally aligned panel assemblies for rigidly joining the panel assemblies to the panel connecting member. The panel connecting member also preferably mounts thereon a manually-actuated panel lock which cooperates with the panel assemblies, when the latter are engaged with the hooks of the connecting member, to prevent separation of the panel assemblies from the connecting member. The connecting member is sized and configured so as to be accommodated within channel-like recesses formed in the opposed vertical end edges of aligned panel assemblies so as to be effectively positioned interiorly between the aligned adjacent panel assemblies, with only the row of slots opening outwardly through adjacent panel assembly ends so as to be accessible for engagement with the component hangers.

In the preferred embodiment of the wall system, as aforesaid, a panel connecting member is provided at both vertical end edges of each panel assembly, and a single said connecting member provides for direct connection between two adjacent aligned panel assemblies. However, when two adjacent panel assemblies are disposed in generally perpendicular relationship to one another, then the adjacent end edges are each provided with a panel connecting member secured thereto, and the adjacent pair of connecting members in turn are directly joined together through an intermediate corner connector member which engages the row of hooks on the connecting member which is not engaged with the panel assembly. This same arrangement can be utilized to create not only a two-panel right angle corner, but can be duplicated to create either a three-panel connection or a four-panel connection when the angle between adjacent panels is always about 90°. The same connecting member is also provided for supporting the vertical edge of a panel assembly when such edge defines the free end of a wall system, and a suitable end cap is positioned for engaging the exposed hooks of the connecting member for closing off the end of the wall system.

Further, in the preferred embodiment of the improved wall system, as aforesaid, the panel connecting member mounts thereon a support flange adapted to engage and cooperate with similar support flanges formed on the corner connector member, with the latter support flange being clamped against the support flange on the connecting member by an adjustable clamping flange provided on the corner connector member. This ensures that the panel assemblies are properly elevationally aligned with one another through the intermediate corner connector member.

The present invention also relates to an improved construction for the panel as associated with the aforementioned wall system. The wall panel includes a rectangular ringlike frame defined by rigidly joined horizontal and vertical frame rails, each being of an outwardly opening channel-shaped cross section. These frame rails have outer edge flanges for defining shallow ringlike rims which extends surround both sides of the frame. A sheet of rigid but acoustical fiberboard is secured, as by an adhesive, to each side of the frame with the fiberboard sheet being confined within the surrounding rim. A fiberglass sheet overlies the exterior surface of the fiberboard sheet, and a thin fabric sheet is stretched over the fiberglass layer and has the edges thereof wrapped around the rim and secured to the frame rails. This laminated construction of the panel, and specifically the use of the fiberboard sheet and the overlying fiberglass layer, provide desirable acoustical properties in that such arrangement provides a reasonably high noise reduction coefficient (NRC), such as in the magnitude of 0.65. At the same time this construction enables the panel sidewall to effectively function as a tack board. This panel construction is also reasonably economical to manufacture, and is of reasonably light weight.

The improved wall panel of the invention, as aforesaid, also greatly facilitates the retrofitting of electrical and/or communication ports on the side of the panel, such as at or adjacent worksurface height, after the wall assembly has been fully assembled, with such retrofitting being carried out with minimal time and effort. The opposed side rails of the panel are each provided with one or more preformed sets of openings formed horizontally therethrough for communication with the interior of the panel frame, with each opening set including a large opening for accommodating electrical and/or communication cables, and one or more smaller openings for receiving a fastener. The construction of the panel enables a template to be positioned over the side surface of the panel adjacent a selected edge thereof, after the wall system has been assembled and a desired location for the porting has been determined. Thereafter the fabric is cut at a location as controlled by the template, and then the underlying fiberglass and fiberboard are also cut and portions removed to create an opening sized according to the template and according to the desired cable box which is thereafter inserted into the opening. This box also has a set of openings in a sidewall thereof which generally align with an opening set in the adjacent frame rail. Suitable fasteners such as screws are inserted from interiorly of the box through the sidewall for engagement with the side rail. Suitable cables can then be extended vertically along the channel of the adjacent side rail and fed through the openings for communication with the interior of the box. A cover is secured to the box so as to be substantially flush with the exterior panel fabric, and the cover is provided with suitable porting (such as a telephone jack, an electrical receptacle, or the like) thereon which couples to the appropriate cabling in the box. All of the above described installation is accomplished while the wall panel is assembled into the wall system, and requires only a conventional utility knife for cutting and forming the box-receiving opening.

Other objects and purposes of the invention will be apparent to persons familiar with structures of this general type upon reading the following specification and inspecting the accompanying drawings.

BRIEF DESCRIPTION OF THE DRAWINGS

FIG. 4 is an end elevational view of the main panel member according to the present invention.

FIG. 5 is a side elevational view of the panel connecting member according to the present invention.

FIG. 6 is a fragmentary enlarged view illustrating the hook structure associated with the panel connecting member.

FIG. 7 is an end elevational view of the panel connecting member illustrated by FIG. 5.

Figure 1:
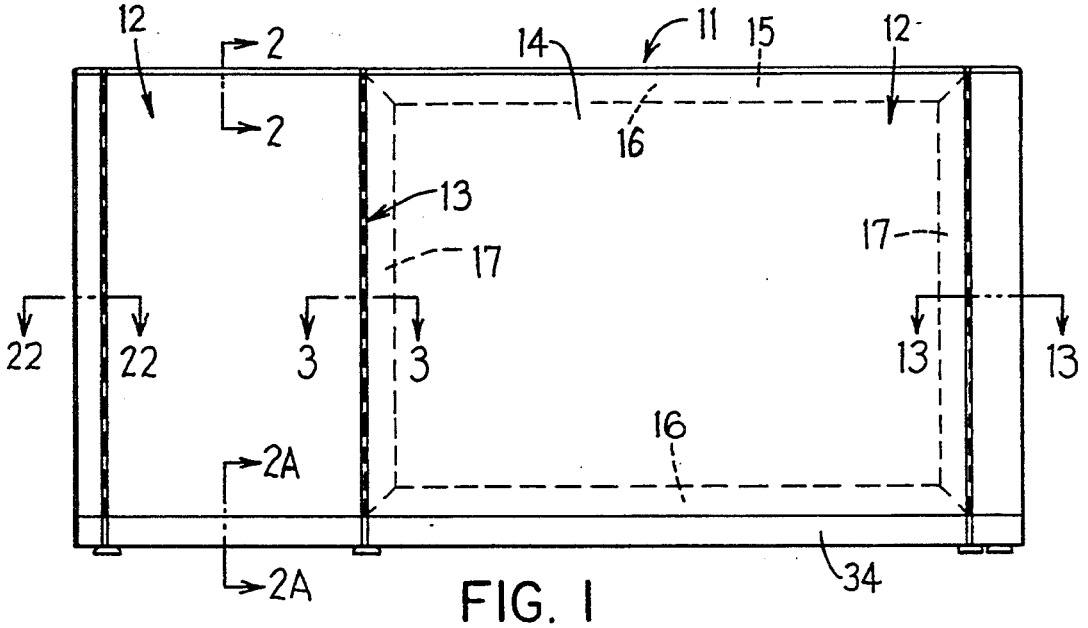
FIG. 1 is a side elevational view which illustrates several panel assemblies joined together to define at least part of an upright space-dividing wall system according to the present invention.

Certain terminology will be used in the following description for convenience in reference only, and will not be limiting For example, the words "upwardly" "downwardly", "rightwardly" and "leftwardly" will refer to directions in the drawings to which reference is made. The words "inwardly" and "outwardly" will refer to directions toward and away from, respectively, the geometric center of the assemblies and designated parts thereof. Said terminology will include the words specifically mentioned, derivatives thereof, and words of similar import.

DETAILED DESCRIPTION

Referring to FIG. 1, there is illustrated an upright space-dividing wall system 11 according to the present invention, which system 11 is formed by a plurality of upright space-dividing panel assemblies 12 which are joined together in a series arrangement to define individual workstations. The panel assemblies 12 are typically joined in either aligned (that is, end-to-end) relationship, or in perpendicular relationship with end edges of two panels being disposed closely adjacent, such arrangements being conventional. The individual panel assemblies 12 typically have a height which is significantly less than floor-to-ceiling height, whereby panel assemblies are supported on and project upwardly from the floor, with upper edges of the panels typically being spaced downwardly a significant distance from the ceiling. The sizes of such panel assemblies, in terms of widths and heights, are conventional.

In the panel system 11 of the present invention, each pair of adjacent aligned panel assemblies 12 are connected together through an intermediate panel connector assembly 13, as explained below.

Figure 2A:
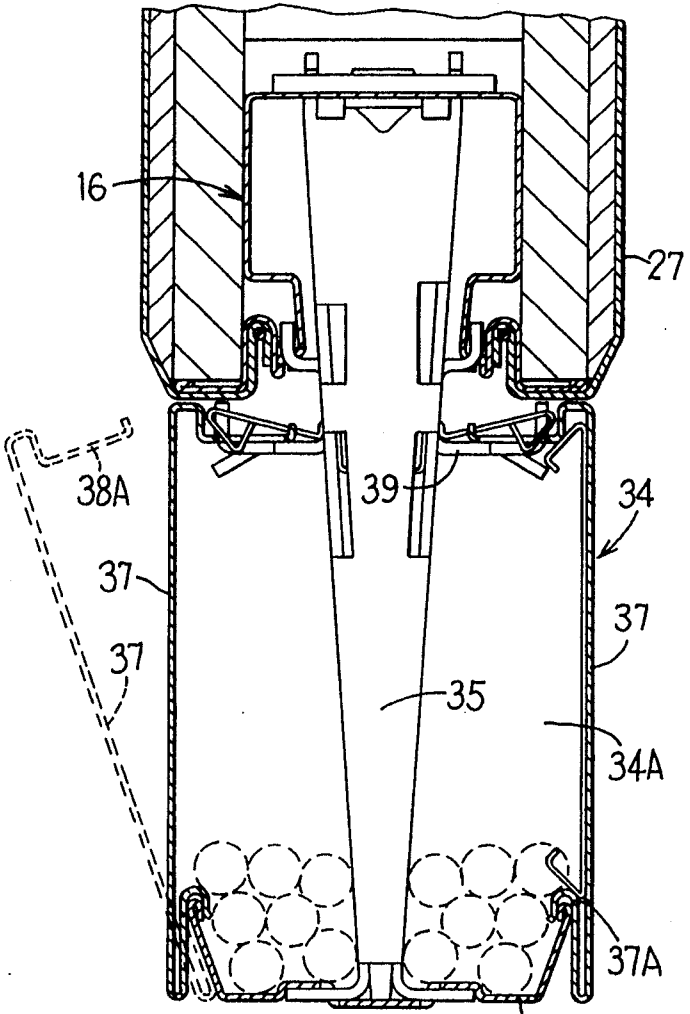
FIGS. 2 and 2A are enlarged fragmentary sectional views respectively taken along lines 2—2 and 2A—2A in FIG. 1.
Figure 2:
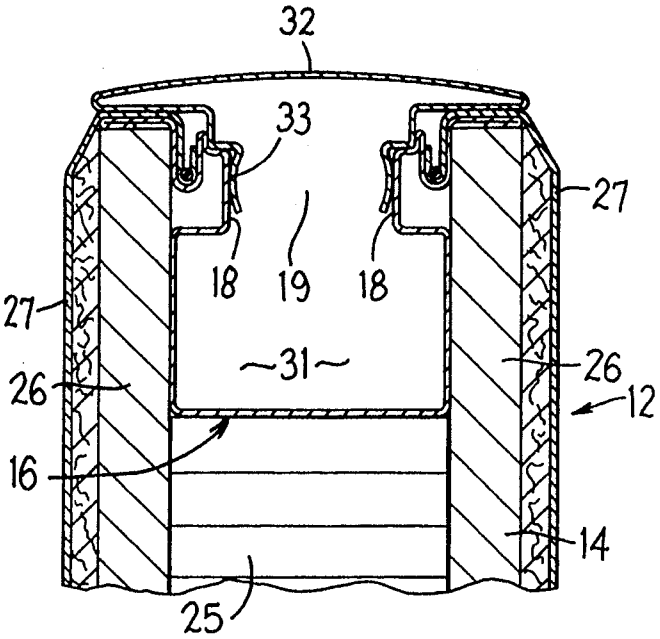
Figure 3A:
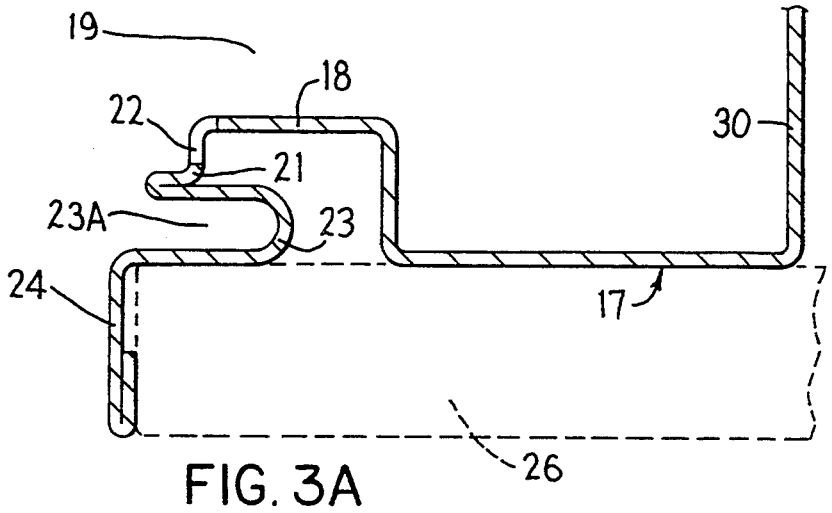
FIG. 3A is an enlarged fragmentary view illustrating the configuration of the panel frame member.
Figure 3:
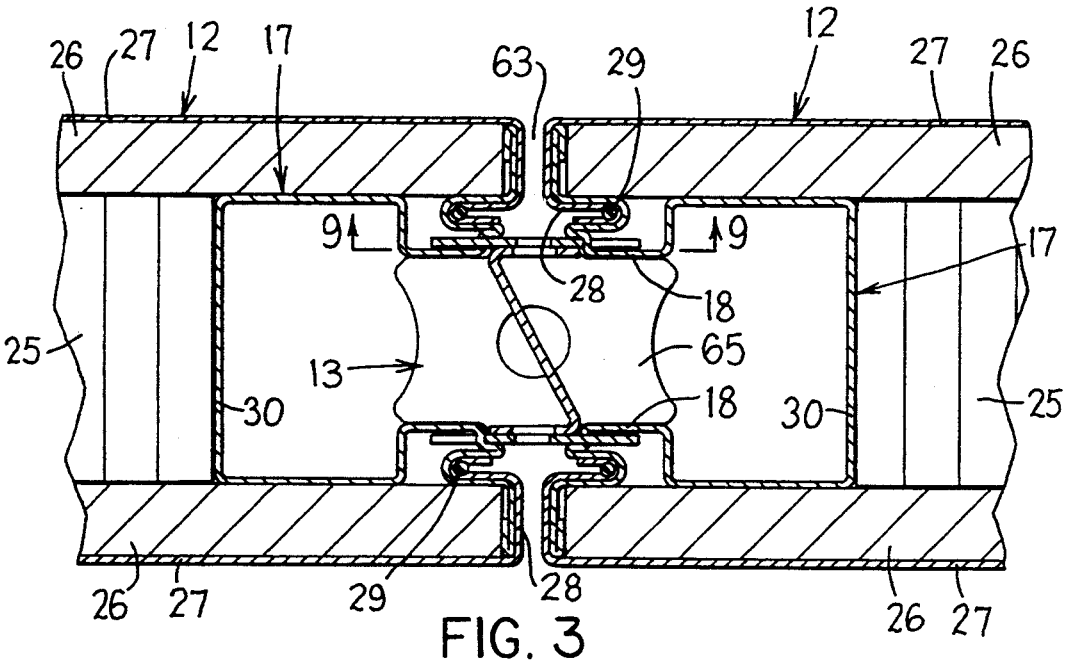
FIG. 3 is an enlarged fragmentary sectional view taken along line 3—3 in FIG. 1 and showing the manner of connecting two aligned panel assemblies through a panel connecting member according to the present invention.

Each panel assembly 12 comprises a main upright panel member 14 of large horizontal width (i.e., length) and height dimensions compared to the horizontal thickness. This main panel member 14 includes a generally rectangular ringlike frame 15 defined by generally parallel and horizontally elongated top and bottom frame members 16 which are rigidly joined together adjacent opposite ends thereof by generally parallel and vertically elongated side frame members 17. These frame members 16 and 17, in a preferred embodiment of the invention, are each of generally identical cross section and, as illustrated by FIGS. 2 and 3, are of a generally outwardly-opening channel-like configuration. Each frame member 16–17 includes a base wall 20 having fixed thereto a pair of generally parallel and outwardly projecting flanges 18 which define a mouth 19 therebetween which opens inwardly into the interior of the respective channel-like frame member. Each flange 18, at its outermost edge, is bent outwardly through a substantially 90° angle to form a wall 21. The walls 21 of side frame members 17 each have a row of vertically elongate and vertically spaced slots 22 formed horizontally therethrough. Wall 22 is in turn joined to a generally U- or channel-shaped part 23 which is spaced sidewardly from the flange 18 and defines therein a channel or groove 23A which extends throughout the elongated length of the frame member and opens outwardly. This channel part 23 in turn has the outer leg thereof, at its free end, bent outwardly through about 90° to form an edge flange 24 which projects toward the adjacent vertical side surface of the panel and defines a vertical end edge of the panel member 14. The edge flanges 24 extend along all of the frame members and hence define a generally rectangular ringlike rim.

The ringlike frame 15, as defined by frame members 16 and 17, surrounds and confines a core structure 25 which fills the interior of the frame. The core structure in the illustrated embodiment comprises a sheet of paper honeycomb, although other conventional core materials can be utilized if desired. The frame 15 and core 25 in turn are sandwiched between a pair of platelike side members 26, the latter being of generally rectangular configuration so as to cover substantially the entire opposite sides of the panel member. The side members 26 directly overlie and are preferably adhesively secured to opposite side surfaces of the frame elements 16–17 and core 25, with the edges of the side members 26 being confined generally within the rim defined by the edge flanges 24 as illustrated by FIGS. 2 and 3. These latter edge flanges 24 project sidewardly by an extent which substantially corresponds to the thickness of the side members 26.

The platelike or sheetlike side members 26 are preferably a one-piece lamina of what is conventionally refer to as mineral fiberboard. Such lamina is a mixture of fibers (such as wood fibers) contained within a particle-type filler, with the filler particles and fibers being suitably secured by a binder. This fiberboard provides a relatively rigid and relatively stiff lamina but possesses physical properties which enable it to function in a highly desirable manner as a tack board in that small pins and the like can be inserted into the board and retained due to the physical properties of the board. This fiberboard also provides desirable acoustical properties, specifically sound-absorption properties, and is preferably provided with small diameter perforations extending inwardly from the outer side thereof, which perforations extend only partway through the thickness of the board. The board 26, in the illustrated and preferred embodiment, has a thickness of about one-half inch, and preferably has a density of about 13 pounds per cubic foot, plus or minus about three pounds per cubic foot. One suitable commercially available fiberboard is Apache Coreboard AP113.

The side members or lamina 26 are additionally preferably covered by a thin layer of fiberglass 30 which extends coextensively over the outer surface of the acoustical sheet 26. The fiberglass layer 30 is typically of lesser thickness than the sheet 26, and is about ¼ inch thickness in the preferred embodiment.

The main panel member 14 is additionally provided with exterior coverings over the laminate defined by the platelike side members 26 and the fiberglass layers 30, which coverings in the illustrated and preferred embodiment comprise enlarged sheets of thin but flexible fabric 27 which are stretched across and entirely cover the outer vertical side faces of the panel member 14. This fabric sheet 27 has edge portions 28 which wrap exteriorly around each of the frame member edge flanges 24 and fold into the groove 24A, with the fabric edge portion 28 being suitably secured within the groove 24A by a retaining element 29. The retaining element 29 is, in a conventional manner, of an endless elastomeric construction so as to extend throughout the grooves 24A which extend entirely around the rectangular frame to maintain the fabric covering 27 in a taut condition. This technique for securing a fabric to a space-dividing panel is conventional. Alternately, the fabric edge portion 28 can be adhesively secured within the groove 24A.

The construction of the panel member, and particularly the laminate sidewall construction defined by the fiberboard side members 26 and the overlying fiberglass layer 30 and fabric sheet 27 has been determined to provide a highly desirable acoustical characteristic in that the combination of fiberboard and fiberglass are effective in significantly reducing noise transmission. In fact, experimental evaluation has indicated that such construction is effective in providing a noise reduction coefficient (NRC) of about 0.65. At the same time, this laminate construction and particularly the presence of the fiberboard beneath the thin fiberglass layer provides the panel with a side surface which is reasonably soft upon touch or contact, but which still effectively and desirably functions in a manner similar to a tack board so as to permit the sidewall of the panel to have papers and like articles pinned thereto without requiring provision of a separate tackable surface.

Each of the elongate frame members 16–17 includes an interior channel or compartment 31 which, as illustrated by the top frame member 16 in FIG. 2, opens upwardly through the top edge of the panel and can be utilized for storage of cables, such as communication cables, the latter being capable of being fed through the top channel 31 from panel to panel. The top of the panel member additionally has a removable top cap 32 associated therewith for spanning the width of the top edge of the panel and for closing off the channel 31. This top cap 32 has a pair of sidewardly spaced and downwardly projecting resilient legs 33 which project into the mouth 19 and resiliently engage the opposed side flanges 18 to securely but releasably attach the top cap to the top frame rail 16.

The lower edge of the panel member has a raceway arrangement 34 (FIG. 2A) associated therewith and extending therealong. The raceway arrangement includes two or more longitudinally spaced support legs 35 which are fixed to the bottom frame rail 16 and project downwardly therefrom for supportive engagement with a bottom pan or tray 36, the latter being adapted to be positioned closely adjacent the floor. This pan 36 has a width which substantially corresponds to the panel thickness, and a pair of side covers 37 cooperate with the pan 36 to define an interior channel or raceway 34A which extends lengthwise along the lower edge of the respective panel member. Each cover 37 has a hook part 37A adjacent the lower end thereof which engages with the upper free edge of a side leg of the pan 36 so as to suitably support the side cover 37, and the latter adjacent its upper end has an inwardly projecting latching tab 38 which cooperates with a latching flange 39 which projects sidewardly from the support leg 35 to releasably retain the side cover in an upright closed position wherein the side cover is substantially flush with the fabric covering associated with the respective side of the panel assembly. This raceway arrangement 34, and specifically the channel or raceway 34A defined therein, enables cables, such as electrical and/or communication cables, to be disposed therein so as to project lengthwise along the panel system.

Considering now the panel connector assembly 13, and referring specifically to FIGS. 5–7, this assembly includes a vertically elongate panel connector 41 which is designed to directly connect to the vertical edge frame members 16 for enclosure within the vertically extending end edge of the panel assembly. This panel connector 41 includes an upright core member 42 which is of generally Z-shaped cross section and includes generally parallel and sidewardly spaced side legs 43 and 44 joined together by a cross leg 45 which extends generally diagonally between the side legs so as to be fixedly, and here integrally, joined to opposite edges thereof. The side legs 43 and 44 in turn respectively have parallel hook plates 46 and 47 fixedly secured thereto. These hook plates 46–47 directly overlie the exterior surfaces of the respective side legs 43–44 and are fixedly secured thereto in a conventional manner, as by spot welding. These hook plates 46–47 project upwardly in generally parallel relationship throughout substantially the entire height of the main panel member 14. The hook plate 46 has rows of identical hooks 48 and 49 projecting horizontally outwardly in opposite directions from the respective opposite side edges thereof, with the hooks 48 and 49 being disposed in uniformly spaced relationship along rows which project generally vertically of the panel connector 41. The hooks 48 and 49 associated with the opposite side edges of the hook plate 46 are alternately vertically spaced, that is, the hooks 49 are disposed at vertical locations which are midway between the vertical locations of the adjacent hooks 48, and vice versa.

The other hook plate 47 also has pluralities of hooks 51 and 52 projecting outwardly in opposite directions from opposite side edges thereof, with the size and positioning of these hooks being identical to that of the hooks 48–49. In fact, the hook plates 46–47 are identical. However, they are horizontally reversely oriented so that the hooks 48 and 52 which project in generally the same direction are nevertheless vertically staggered, that is, the hooks 52 are positioned vertically midway between adjacent vertically spaced hooks 48, and vice versa. The same positional relationship also exists with respect to the hooks 49 and 51 which project in the same direction from the opposite side of the panel connector 41.

Considering now the configuration of the hooks, and referring specifically to FIG. 6 wherein there is illustrated the configuration of the hook 49, the latter has a generally T-shaped configuration as it projects horizontally outwardly in cantilevered relationship from the side edge of the hook plate. This T-shaped configuration is defined by a base or leg part 53 which joins to the side or vertical edge 54 of the hook plate and projects horizontally outwardly for connection to a vertically extending head part defined by upwardly and downwardly projecting hook parts 55 and 56, respectively. Each hook part 55–56 has a rear edge 57 which is inclined so as to converge relative to the vertical edge 54 as the edge 57 projects away from the free corner of the hook part. This inclined edge 57 in turn joins to a rear slot edge 58 which is spaced outwardly a small distance from vertical edge 54 to define a slot 59 which terminates at the base part 53. This identical slot configuration is provided behind each of the upper and lower hook parts 55 and 56 so that the latter respectively define upwardly and downwardly opening slots 59.

Figure 8:
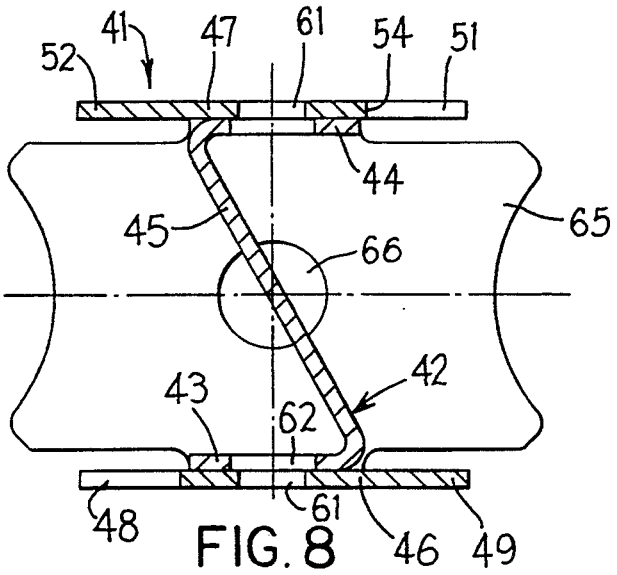
FIG. 8 is an enlarged sectional view taken substantially along line 8—8 in FIG. 5.

Each hook plate 46 and 47, as illustrated by FIGS. 5 and 8, has a plurality of vertically elongate slotlike openings 61 formed therethrough, with the plurality of slotlike openings 62 being disposed in uniformly spaced relationship along a row which extends generally vertically throughout a majority of the length of the panel connector 41. Each of the slots 61 aligns with a similar slot or opening 62 formed through the respective side leg 43–44 to hence provide access into the interior of the panel connector. However, as illustrated by FIG. 8, due to the Z-shaped configuration of core member 42 and the diagonal positioning of the cross leg 45, the slots 61 on one side of the panel connector 41 are isolated from the slots 61 provided on the other side of the panel connector. This diagonal cross leg 45 effectively functions as a barrier for isolating the opposed rows of slots 61 from one another to minimize direct communication therebetween and transmission of sound from one side of the panel system to the other.

The panel connector assembly 13 also includes an alignment plate 65 which is fixedly secured to the panel connector 41 adjacent the lower end thereof. This alignment plate 65 is a horizontally enlarged plate of generally rectangular configuration having a sideward dimension so that the plate is positioned generally between and is fixedly secured to the opposed side legs 43–44, with the plate projecting horizontally outwardly in opposite directions through an extent slightly greater than the projection of the hooks, as illustrated by FIG. 8. This alignment plate 65 has a central opening extending vertically therethrough and in which is fixedly captivated the upper end of a vertically downwardly projecting support post or rod 66, the latter having an internally threaded opening 67 formed therein and opening downwardly through the lower end thereof. This threaded opening 67 accommodates therein the upwardly projecting and externally threaded support post 68 which has its lower end fixed to an enlarged foot or glide 69, the latter being adapted for direct supportive engagement with the floor.

The panel connector assembly 13 also has a panel lock 71 (FIGS. 5 and 7) provided on the upper end of the panel connector 41. This panel lock 71 is of a generally upwardly-opening U-shaped configuration and includes a base wall 72 which is seated directly over the upper end of the panel connector 41 and extends between and is rigidly joined to a pair of generally parallel sidewalls 73 which project upwardly in sidewardly spaced but parallel relationship. These sidewalls 73 project upwardly in generally coplanar relationship with the respective hook plates 46–47, and each sidewall 73 is of a generally T-shaped configuration defined by an upwardly projecting base part having a pair of generally L-shaped hooks 74 adjacent the upper end. These hooks 74 project horizontally outwardly in opposite directions in a manner so as to be similar to and aligned generally vertically above the respective hooks 48–49 or 51–52, and each hook 74 defines a downwardly opening slot 75 which is generally aligned with the slots 59. A securing structure in the form of a threaded bolt 76 is provided on the panel lock 71. This threaded bolt 76 projects downwardly through the base wall 72 so as to be threadedly engaged within another alignment plate 77 which is fixedly secured to the cross leg 45 adjacent the upper end thereof. The head of the bolt 76 is vertically captivated in a conventional manner relative to the lock 71, but is rotatable relative to the lock so as to enable the lock 71 to be vertically moved downwardly to engage the upper end of the panel connector 41 by rotatable engagement of the threaded bolt 76 into the alignment plate 77.

Figure 10:
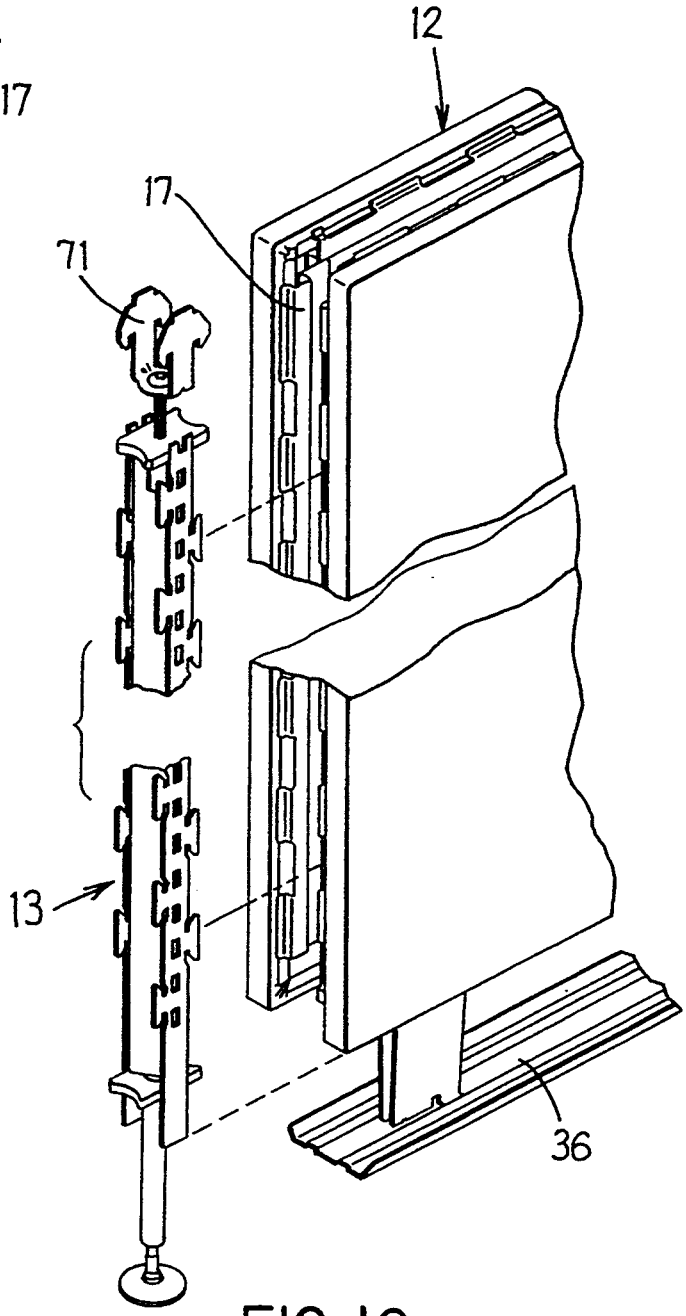
FIG. 10 is a fragmentary, exploded perspective view illustrating the relationship between an upright panel connector and an adjacent edge of one panel.

The panel connector 41 is adapted to directly engage opposed side frame rails 17 associated with adjacent ends of a pair of aligned panels, substantially as illustrated by FIG. 3 and as explained in detail below. However, when the adjacent ends of two panels are to be connected together with the panels disposed in angled relationship to one another, specifically perpendicular as illustrated by FIG. 10, then each panel has panel connector assembly 13 connected to the respective side frame rail 17, and the adjacent connectors 13 in turn are connected through a separate corner connector 81.

Figure 13:
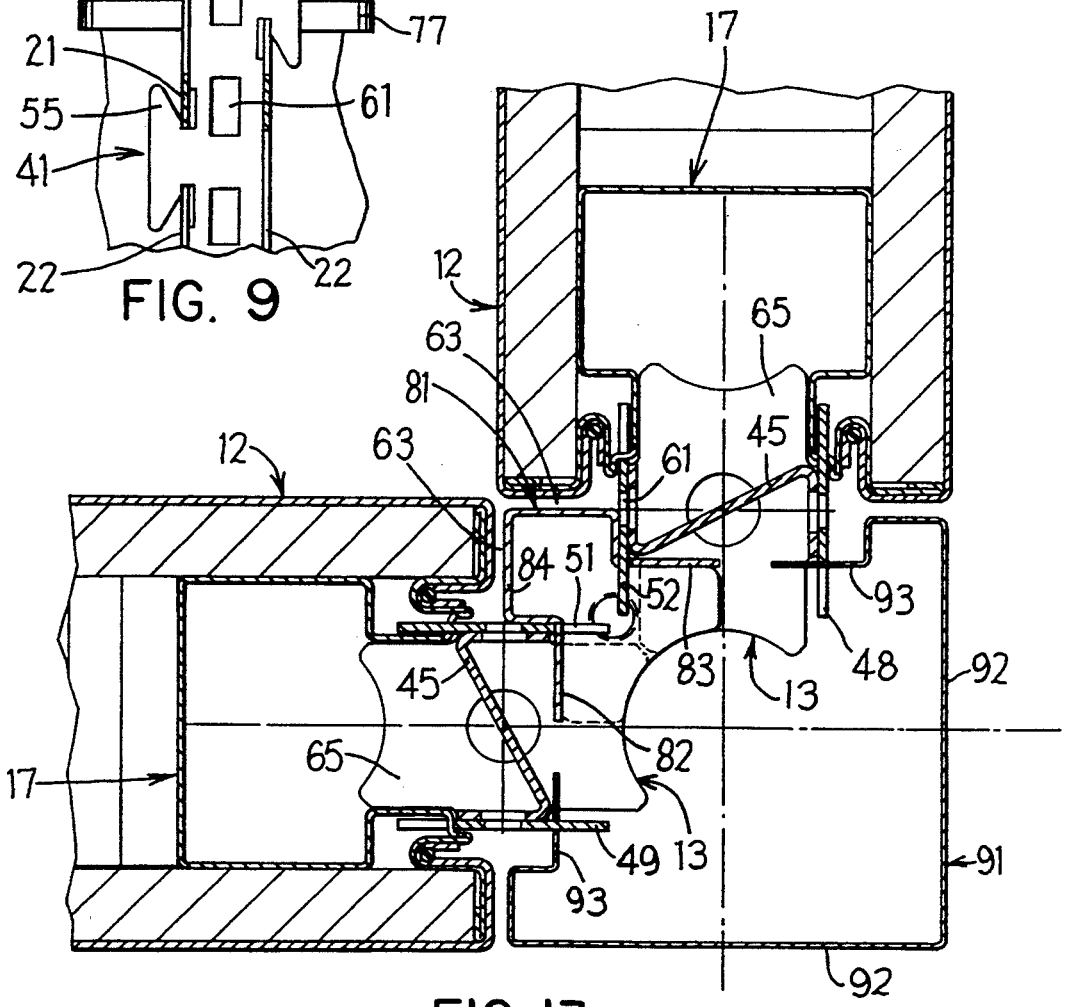
FIG. 13 is an enlarged fragmentary sectional view taken substantially along line 13—13 in FIG. 1 and showing a right angle corner connection between two panel assemblies according to this invention.
Figure 11:
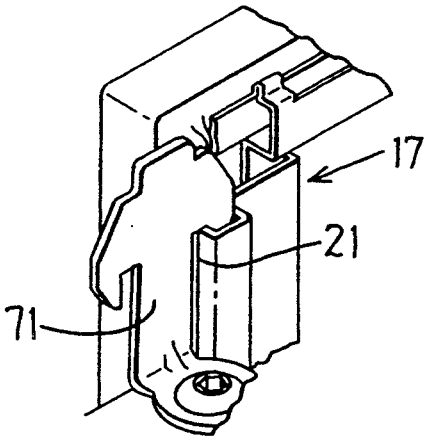
FIG. 11 is an enlarged fragmentary perspective view illustrating the manner in which the locking member secures to the panel frame rail.
Figure 12:
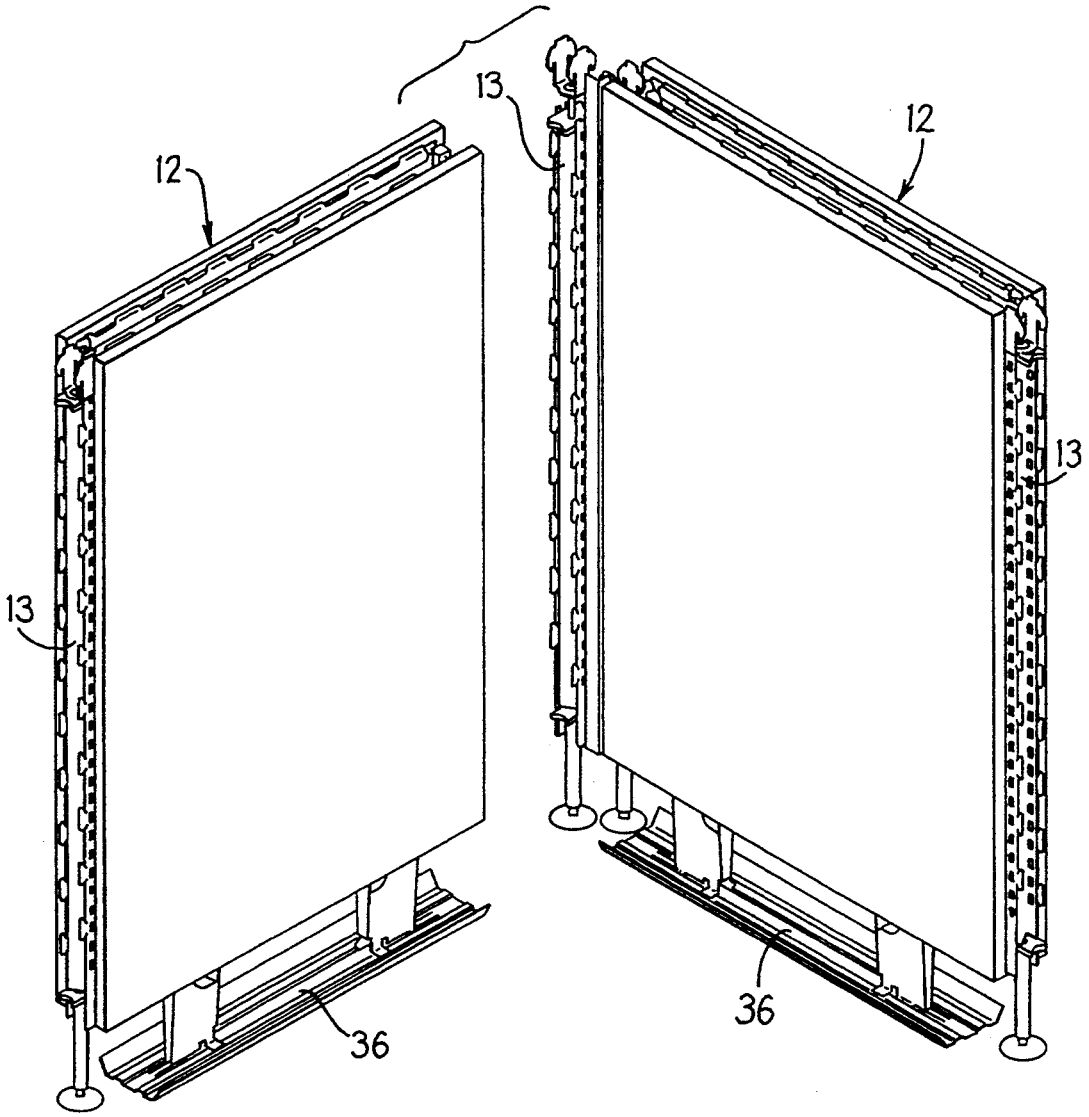
FIG. 12 is a perspective view illustrating two panel assemblies which connect together in right angle relationship, with one panel assembly being separated from the other for clarity of illustration.
Figure 14:
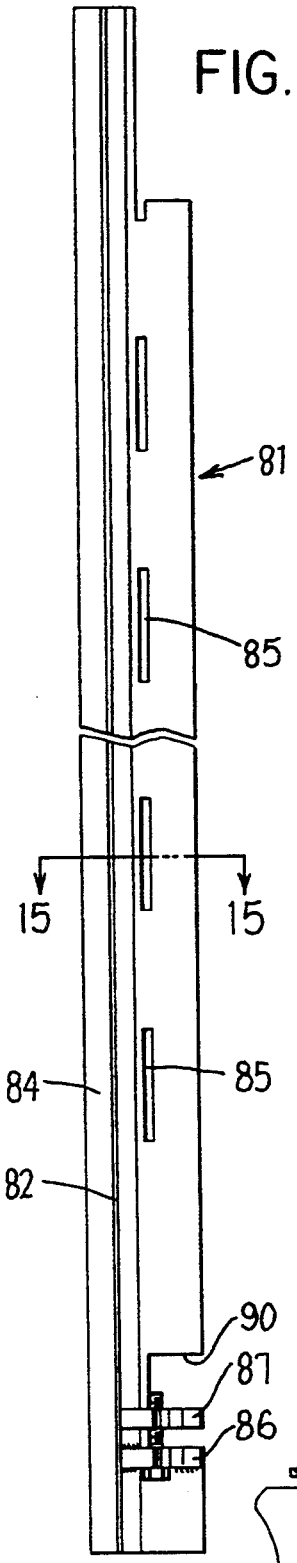
FIG. 14 is an elevational view of the corner connector utilized in making the corner connection of FIG. 13.

Referring to FIGS. 11–13, the corner connector 81 includes a vertically elongate rail-like member which includes, in horizontal cross section, a pair of side legs or flanges 82 and 83 which are vertically elongate and extend in generally perpendicular relationship to one another. These legs 82 and 83 are rigidly, and here integrally, joined at the apex of the member by a channel-like apex part 84. This channel part 84 defines a vertically extending channel or groove 84A in the interior thereof, which groove opens outwardly between the legs 82 and 83. Each of the legs 82 and 83 also has a plurality of vertically elongate slots 85 extending horizontally therethrough, which slots are disposed in uniformly and vertically spaced relationship throughout the vertical extent of the respective leg so that the slots are hence disposed substantially within a row. The slots 85 are dimensioned so as to permit the hooks 48–49 and 51–52 to extend therethrough, and the vertical spacing between adjacent slots 85 corresponds to the vertical spacing between pairs of vertically aligned and adjacent hooks.

Corner connector 81 has a clamping arrangement associated with the lower end thereof, which clamping arrangement includes a lower clamping plate 86 which is fixed to and extends transversely across the interior of the connector member with the plate 86 being fixed, as by welding, to the inner surfaces of the legs 82 and 83. An upper clamp plate 87 is disposed above the fixed clamp plate 86 and is vertically movably supported relative to the connecting member. This movable clamping plate 87 includes a guide part 87A which is vertically slidably confined within the guide channel 84A so as to restrict the movable clamping member 87 for solely vertical displacement. A bolt 88 is provided for threaded engagement with the movable clamping plate 87 to control vertical displacement thereof. This bolt 87 has the threaded stem thereof projecting through a clearance opening 89 provided in the fixed clamping plate 86, and the head of the bolt 88 is preferably disposed directly below the fixed clamping plate 86 and is rotatably captivated relative thereto in a conventional manner so as to be carried on but rotatable relative to the fixed clamping plate 86.

The legs 82 and 83, directly above the fixed clamping plate 86, are provided with cutouts or recesses 90 so as to enable the alignment plates 65 associated with the panel connector assembly 13 to project into and be clampingly engaged between the clamping plates 86 and 87 when two adjacent panels are rigidly connected in right angled relationship, as explained below.

When two panels are joined in right angled relationship to define a corner as illustrated by FIG. 10, then there is preferably provided a vertically elongate corner cover 91 defined by side legs 92 which extend in generally perpendicular relationship to create an L-shaped configuration which defines the exterior corner, with the legs 92 being substantially flush with exterior side surfaces of the adjacent interconnected panel assemblies. Each of these legs 92 has, adjacent the free end thereof, an inwardly directed flange 93 adapted to cooperate with an adjacent row of hooks associated with a respective connector member 41. Each said flange 93 has a vertically extending row of spaced slots (similar to the slots 85 associated with the corner member) to provide engagement with an adjacent row of hooks associated with the connector member 41.

Figure 15:
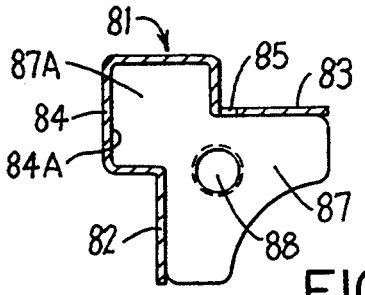
FIG. 15 is a sectional view taken substantially along line 15—15 in FIG. 14.

When three panels are joined in a generally T-shaped configuration as illustrated by FIG. 15, then the gap between the adjacent aligned panels is closed by a T cover 94 which includes a base wall 95 which aligns with the outer surfaces of the adjacent aligned panels, with this base wall having flanges 96 projecting inwardly therefrom and provided with rows of slots extending vertically thereof for engagement with rows of hooks on the adjacent panel connectors 41. This T cover 94 is of a generally U-shaped configuration so as to occupy the gap and generally close off the vertical space between the aligned panels, which panels are spaced apart by the width of the perpendicularly extending third panel.

Figure 17:
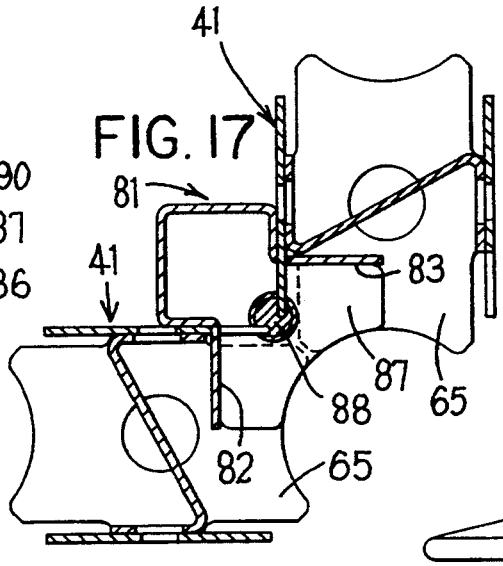
FIG. 17 is a fragmentary sectional view taken substantially along line 17—17 in FIG. 16.
Figure 18:
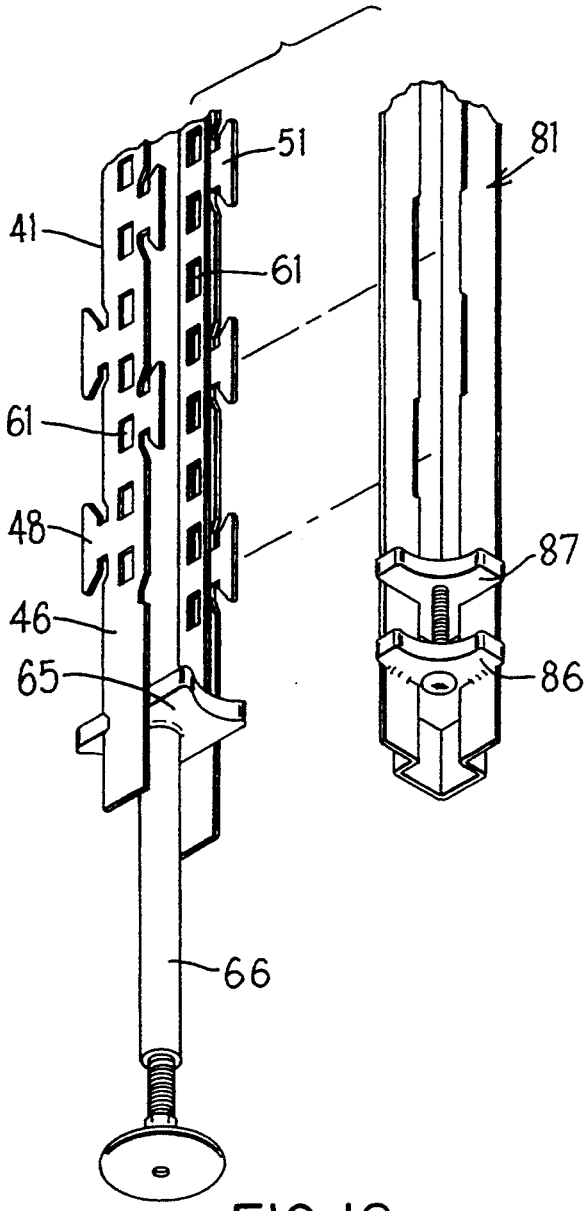
FIG. 18 is a fragmentary, exploded, perspective view illustrating the lower ends of and the relationship between a panel connector and a corner connector.
Figure 19:
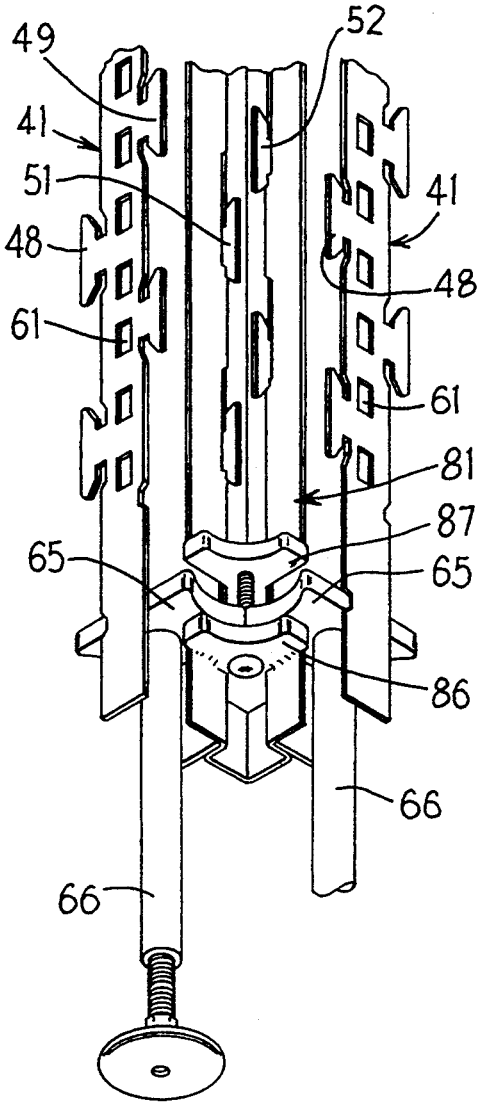
FIG. 19 is a view similar to FIG. 18 but illustrating a corner connector joined between two panel connectors, such as for joining two panels in right angled relationship.
Figure 20:
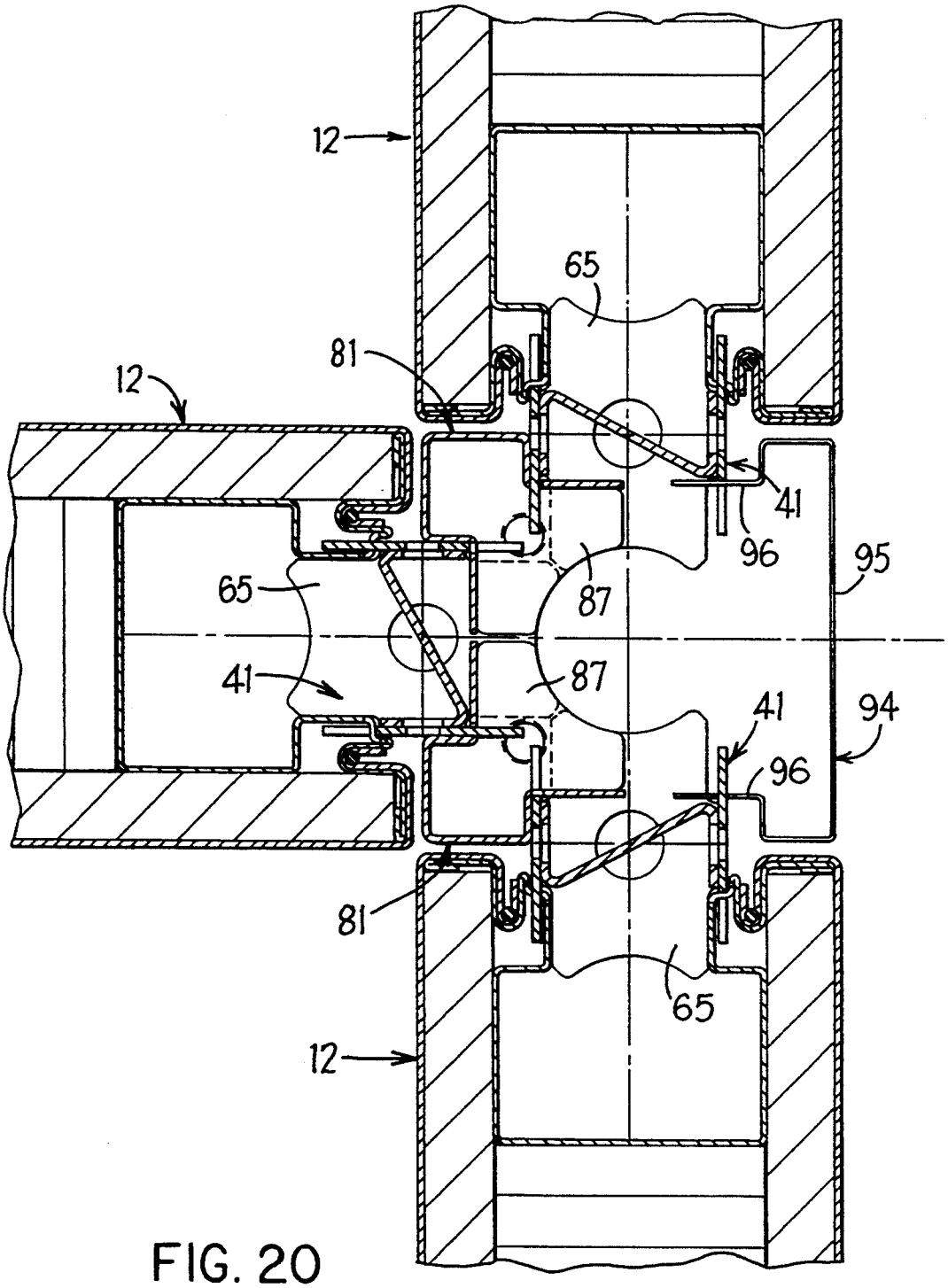
FIG. 20 is a fragmentary, horizontal sectional view similar to FIG. 13 but illustrating a three-panel connection.
Figure 21:
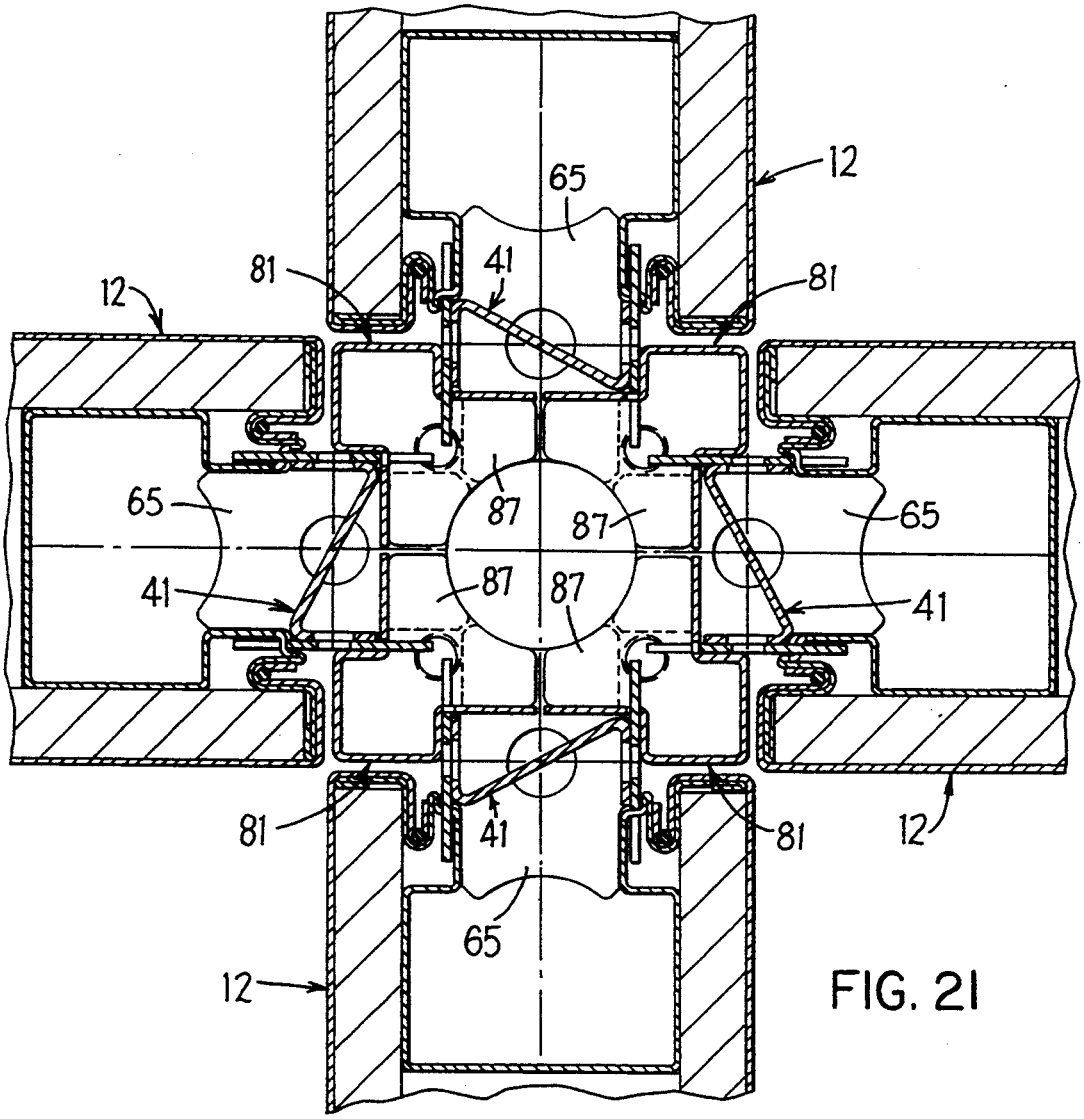
FIG. 21 is a view similar to FIG. 20 but illustrating a four-panel connection.
Figure 22:
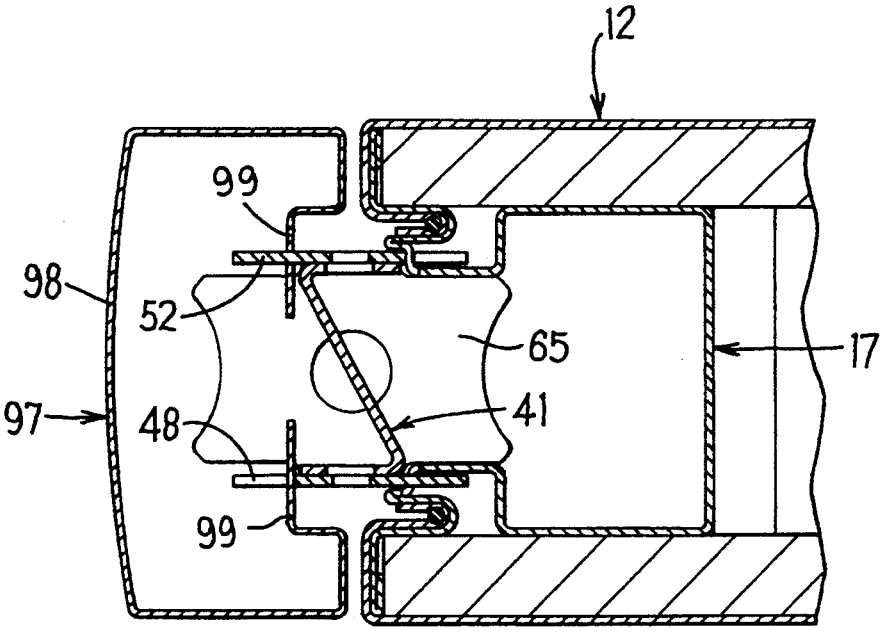
FIG. 22 is an enlarged, fragmentary sectional view taken along line 22—22 in FIG. 1 and illustrating a connection as provided at the free edge of a panel run.
Figure 23:
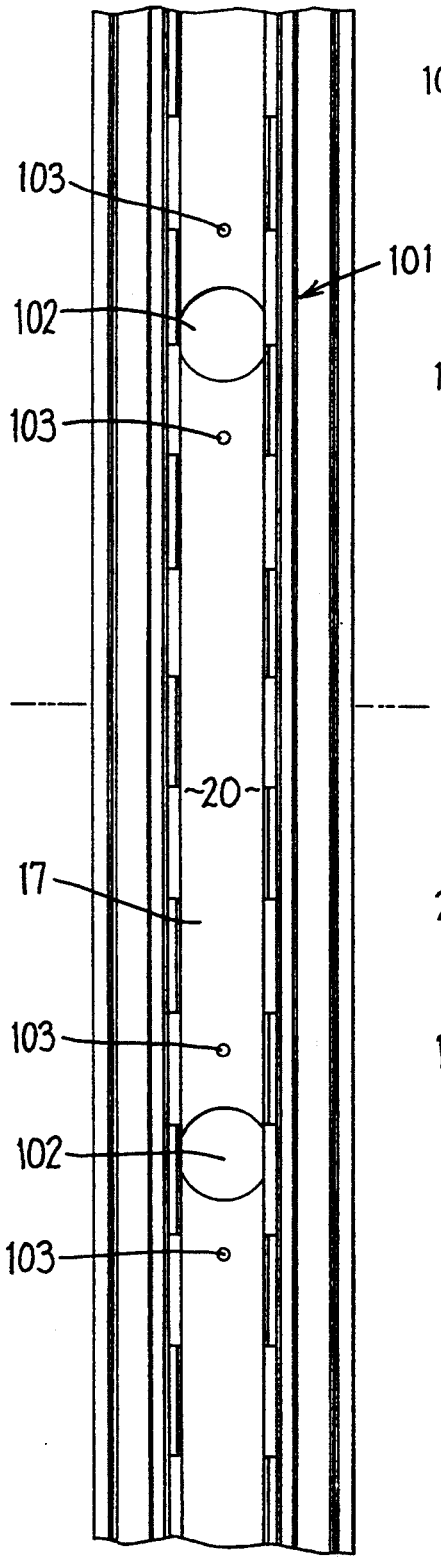
FIG. 23 is a fragmentary elevational view of the end of a panel.
Figure 24:
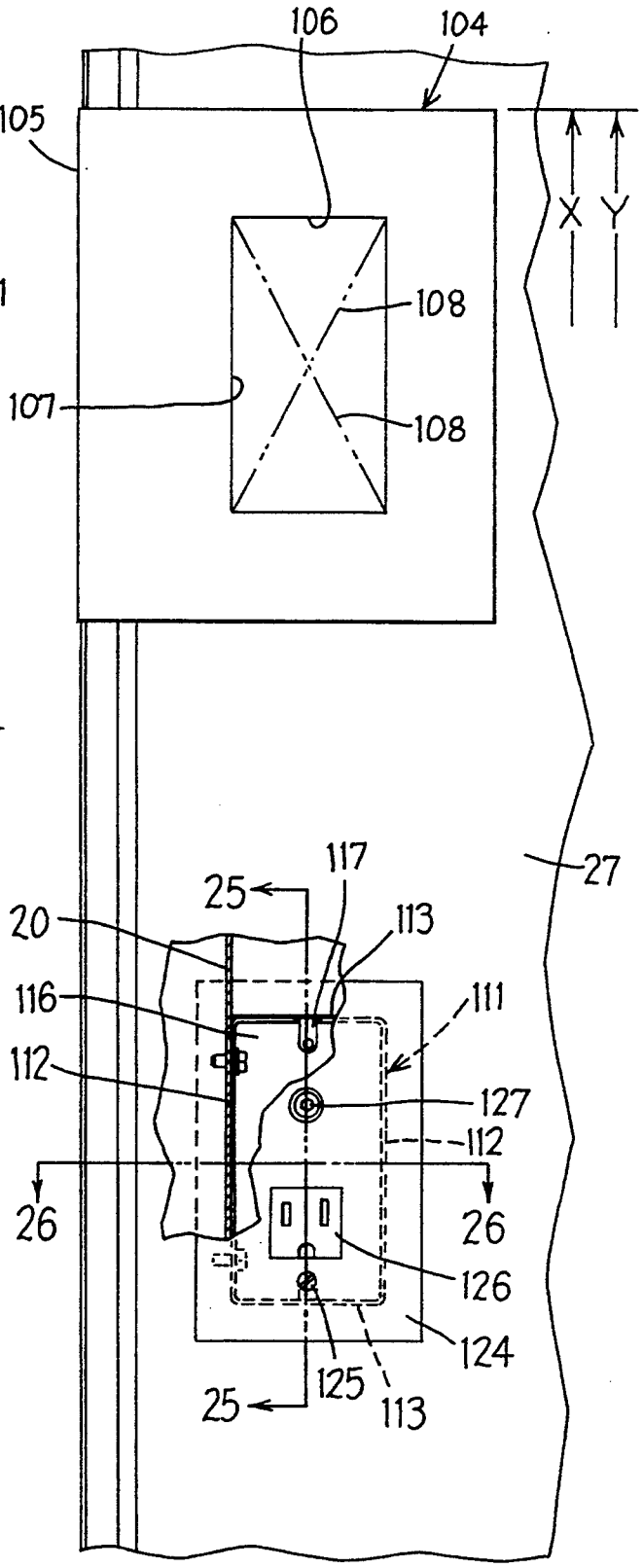
FIG. 24 is a fragmentary side elevational view of a part of a panel adjacent one edge rail thereof.
Figure 25:
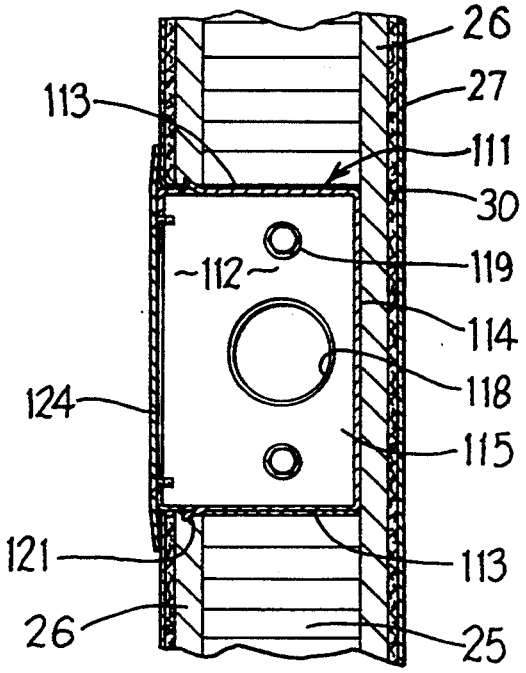
FIG. 25 is a fragmentary view taken substantially along line 25—25 in FIG. 24.
Figure 26:
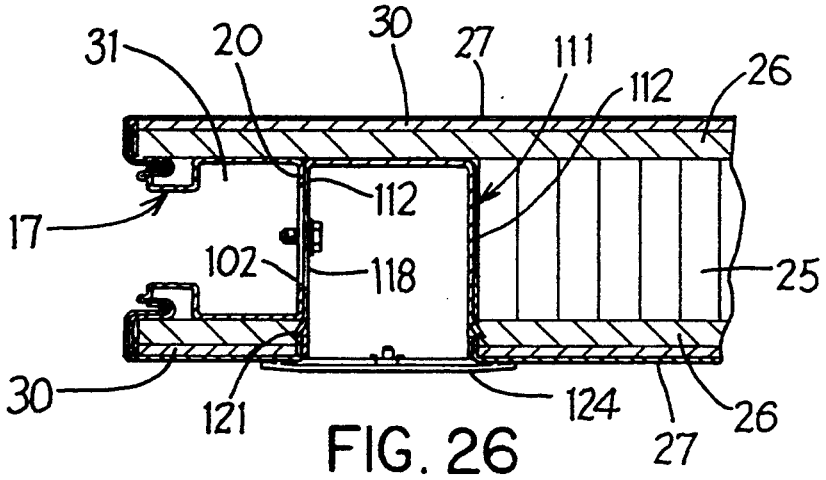
FIG. 26 is a sectional view taken substantially along line 26—26 in FIG. 24.

In a similar fashion, when one of the panels defines the free end of the panel run, as illustrated by FIG. 17, then there is provided a generally hollow vertically-elongate tubelike end cover 97 which includes a generally U-shaped channel part 98 provided with flanges 99 projecting inwardly toward one another from the free ends of the legs of the U-shaped channel part. These flanges 99 are provided with vertically extending rows of spaced slots therein for engagement with a row of hooks associated with the panel connector 41 which joins to the free vertical end edge of the panel.

The assembly of the panel system 11, and the structural and functional cooperation of the individual panel assemblies 12 with the panel connector assemblies 13 and the corner connectors 81, will be briefly described to ensure a complete understanding of the invention.

Figure 9:
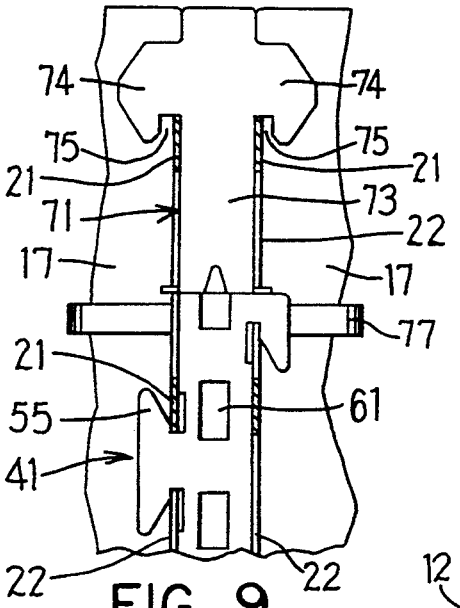
FIG. 9 is a fragmentary sectional view taken substantially along line 9—9 in FIG. 3.

The panel members 14 are generally preassembled in the factory, with the exception of the raceway arrangement 34 which is typically shipped separately and field assembled. To secure two or more panel members in aligned series relationship such as depicted in FIG. 1, then a single panel connector assembly 13 is provided and cooperates directly between the adjacent upright end edges of two such panel members 14 for rigidly joining same together in generally horizontally aligned relationship. To accomplish the series connection of two such panel members 14, a panel connector assembly 13 is hooked at each end edge of a first panel member 14, such being accomplished by engaging one pair of sidewardly spaced rows of hooks 48, 52 or 49, 51 into engagement with the two vertically extending rows of slots 22 associated with each side frame rail 17. The hooks 48, 52 or 49, 51 are initially inserted through the slots 22, and then the panel connector assembly 13 is lifted upwardly relative to the panel member 14 to cause the portions of wall 21 as located between slots 22 to lock behind the upper hook parts 55 as illustrated by FIG. 9.

After a first panel member 14 has had a pair of connector assemblies 13 engaged with opposite vertical end edges thereof, then a second panel member can be directly series coupled to the first panel member by having the vertical edge rail 17 thereof engaged with the remaining two rows of outwardly projecting hooks which project from the other side of the connector assembly 13. This results in the two panel members 14 being directly rigidly joined together in adjacent and aligned relation, with the rigid and structural interconnection being accomplished solely by the panel connector 41. Further, the weight of the panels is transmitted to a support surface such as a floor solely due to the engagement of the glides or feet 69 associated with the panel connector assemblies 13, which glides can be suitably vertically adjusted to provide for desired leveling of the wall system in a conventional manner.

With each pair of aligned panel members 14 joined through a single intermediate panel connector assembly 13, the panel connector assembly 13 is effectively sandwiched within a generally rectangular opening defined between the two panel members so as to be effectively hidden between the panel members with the latter having the vertical end edges thereof disposed closely adjacent and separated from one another solely by a small vertically extending clearance gap or slot 63, as illustrated by FIG. 3. This narrow clearance slot 63 between adjacent aligned panels is directly aligned with the hanger slots 61 provided in the connector assembly 13 so that conventional hangers associated with furniture components such as cabinets or the like can be positioned adjacent the side surface of the panel member with the hangers of the accessory projecting through the slot 63 for engagement with the slotlike openings 61. In this fashion, the weight of the components is transmitted directly to the panel connecting assemblies 13 which in turn directly supportingly engage the floor, and hence the weight or load of the accessories is not imposed on the panel members 14. This minimizes the strength requirements of the panel members 14 and permits more economical construction thereof. When the connector assembly 13 is hooked between the opposed vertical edge rails 17 of a pair of aligned and adjacent panel members 14, the alignment plates 65 and 77 project into the opposed mouths 19 of the adjacent and opposed side frame rails 17 so that the plates 65 and 77 are substantially closely confined between the pairs of generally parallel flanges 18, as illustrated by FIG. 3.

During initial connection of the intermediate connector assembly 13 between the opposed edge frame rails 17, the panel lock 71 is maintained in its raised position until the hooks on the connector assembly 13 are engaged with the opposed edge frame rails 17 of the two panel assemblies. Thereafter the locking bolt 76 is rotated which, due to its threaded engagement with the fixed alignment plate 77, causes the lock 71 to be drawn downwardly until the hooks 74 project downwardly into the upper ends of the channel-like spaces which extend vertically downwardly behind the rail walls 21, whereby the upper edges of the walls 21 enter into the hook slots 75 substantially as illustrated by FIG. 9. This panel lock 71 thus prevents separation of the panel members 14 from the panel connector 41 unless the locking bolt 76 is first rotated into a released position.

In a situation wherein one of the panel members defines the free edge of a panel run, as illustrated by FIG. 17, then in such case the free edge of the last panel member 14 is again provided with a panel connector assembly 13 engaged therewith for supporting the free edge of the last panel member. To close off the panel connector assembly 13 located at the free edge, however, the end cover 97 is provided having a size and configuration compatible with the panel members so as to provide a finished appearance. This end cover 97 is positioned so that the slots associated with flanges 99 are aligned with the projecting sidewardly-spaced pair of hooks 48, 52, with these hooks passing through the slots in the flanges 99 and the end cover 97 then being moved downwardly to lock the cover on the hooks. This hook-and-slot arrangement cooperates in the same manner as illustrated by FIG. 9.

When two panel assemblies are to be disposed in adjacent but right angled relationship so as to define a corner substantially as illustrated by FIG. 10, then the end frame rail 17 associated with each panel assembly is provided with a panel connector assembly 13 fixedly secured thereto, which connector 13 joins to the frame rail 17 in the same manner described above, and the two panels and the respective connector assemblies 13 are then disposed in closely adjacent but right angled relationship. A corner member 81 is then provided to create a fixed structural connection directly between the two corner-related panel connector assemblies 13. This corner connector 81 is initially disposed and aligned with one of the row of hooks, such as the hooks 51 associated with the lower panel in FIG. 10, and the corner connector is then moved so that the hooks 51 project through the slots 85 to secure the leg 82 to the respective panel connector assembly 13. When joining the corner connector 81 to the connector assembly 13 of the illustrated bottom panel assembly, the lower fixed clamp plate 86 on the corner connector 81 is moved into a position below the projecting corner portion of the respective alignment plate 65. This is permissible since the corner connector 81 is initially moved horizontally so that the hooks 51 move through the slots 85, and then the corner connector 81 is vertically displaced upwardly relative to the respective panel connector assembly 13 so that the wall 82 of the corner connector 81 moves upwardly into engagement with the slot defined behind the lower hook parts 56 of the hooks 51. This enables the lower fixed clamping plate 86 to be effectively moved upwardly into abutting engagement with the underside of the alignment plate 65, which plate is now disposed vertically between the clamping plates 86 and 87.

In a similar fashion, the other panel assembly (i.e., the upper panel assembly in FIG. 10) is now joined to the corner connector 81 by positioning the panel assembly in a slightly raised position so that the hooks 52 are aligned with the slots 85 in the other leg 83 of the corner connector, following which the panel assembly is moved inwardly to cause the hooks 52 to project through the slots 85. This again results in the lower fixed clamping plate 86 being disposed below and slightly vertically spaced downwardly from a corner portion of the respective alignment plate 65. The panel assembly is then moved vertically downwardly relative to the corner member 81 which causes the lower hook parts 56 of the hooks 52 to securely engage the lower walls of the hook slots 85 of the corner connector, and also cause the corner portion of the alignment plate 65 to move downwardly into engagement with the lower fixed clamping plate 86 to provide horizontal alignment between the adjacent corner-connected panel assemblies. Thereafter the clamping bolt 88, the head of which is accessible from below by a suitable wrench, is rotated to hence move the upper clamping plate 87 downwardly so as to securely clamp the pair of alignment plates 65 between the opposed clamp plates 86 and 87. This provides the desired vertical leveling between the adjacent panels, and thereafter one or both of the glides associated with the two corner-connected panel connector assemblies 13 can then be vertically adjusted to provide for more uniform distribution of load on the floor.

The corner cover 91 can thereafter be hooked onto the corner assembly by inserting the remaining hooks 49 and 48 through the slots formed in the flanges or legs 93, following which the corner cover 91 is moved vertically downwardly to secure the cover in engagement with the hooks to securely hold it in position.

Figure 16:
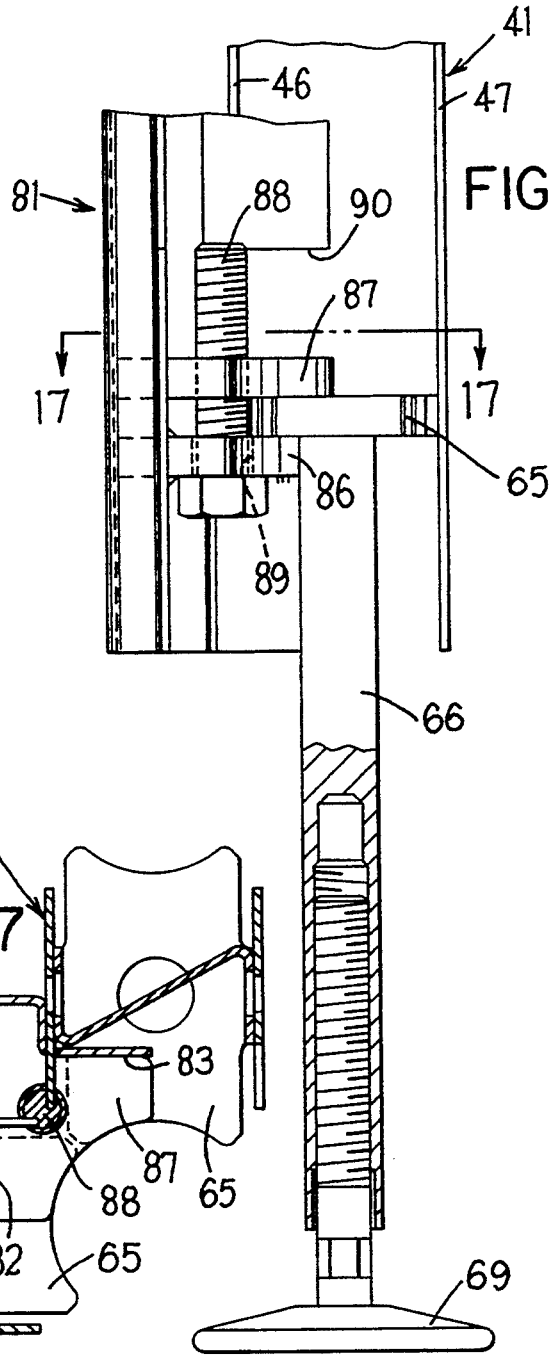
FIG. 16 is an enlarged fragmentary view illustrating the manner in which the lower end of the corner connector interlocks to the lower end of a panel connecting member.

When three or more panels are to be joined to create either a T configuration or a cross configuration as illustrated by FIGS. 15 and 16, respectively, then each adjacent pair of right angled panels is rigidly joined together by means of a single corner connector 81 cooperating between the two adjacent panel connector assemblies 13 in the same manner as described above with respect to FIG. 10. The only difference, however, is that each panel which extends in perpendicular relationship between and is joined to a pair of aligned panels, such as the center leftward panel in FIG. 15, has its panel connector assembly 13 joined to a pair of corner connectors 81, with each of these connectors 81 being joined to one of the adjacent right angled panel assemblies. The connection of three or four panels as illustrated by FIGS. 15 and 16 is identical to but merely a series extrapolation of the connection of two panels as described above relative to FIG. 10.

As also illustrated by FIG. 10, when two panels are joined in a right angle corner and are connected through the intermediate corner connector 81, the channel part 84 of connector 81 cooperates with the adjacent ends of the panels in the same manner as when two panels are connected in direct aligned relationship so as to provide narrow slots 63 which permit access to the rearwardly positioned hanger slots 61, and at the same time this channel part 84 effectively provides a closure for otherwise shielding the internal region of the corner as defined between the adjacent panel assemblies. This improves the overall appearance of the assembled wall system.

The provision of separate corner connectors 81 for cooperation with the hooks of the panel connectors 41 of adjacent panels also enables the corner connectors 81 to be constructed of heavier gauge or thickness metal than is used for the end rails 17, thereby providing the desired load-carrying strength and capacity at the areas needed, without having to oversize or over design all areas so as to meet the minimal requirements of the heavily loaded areas. This permits more economical material usage.

The improved wall system of the present invention, and specifically the improved construction of the panel assembly 12, also facilitates retrofitting of electrical or communication ports at or adjacent worksurface height on selected wall panel assemblies at selected locations after the wall system has been assembled to define workstations. For this purpose, and referring to FIGS. 23–26, each end rail 17 of each panel assembly is provided with at least one, and preferably two, performed sets of openings 101 extending through the base wall 20 thereof. The opening sets 101 are provided intermediate the upper and lower ends of the edge rail 17 and are preferably disposed adjacent worksurface height (i.e., desk or table height) which is typically about 28 to 30 inches above the floor. In the illustrated and preferred embodiment, one opening set 101 is preferably provided just above worksurface height, and another opening set is provided slightly below worksurface height. Each opening set 101 includes a main or large cross section opening 102 for permitting passage of electrical and/or communication cables therethrough, and one or more small openings 103 for accommodating fasteners. Two such openings 103 are preferably provided in vertical straddling relationship so as to be uniformed spaced both above and below the opening 102. Openings 102 and 103 extend through the base wall 20 to provide direct communication between the rail channel 31 and the interior of the panel frame.

A porting box or housing 111 is adapted to be positioned within the interior of the housing directly adjacent one of the opening sets 101. This box 111 is prefabricated and includes generally parallel vertical sidewalls 112 rigidly joined by generally parallel horizontal end walls 113, all of which are rigidly joined to a back wall 114 so as to define therein a compartment 115. The front side 116 of this box is open, although small tabs or flanges 117 project from the end walls 113 generally into the plane of the front side and are provided with tapped holes for accommodating fasteners. At least one of the vertical sidewalls 112 of the box 111 also has an opening set formed therein which substantially corresponds to the opening set 101. The opening set in the box 111 specifically includes a main large cross section opening 118 which permits electrical and/or communication cables to extend therethrough, and a further pair of small openings 119 disposed in vertical straddling relationship to the main opening 118. These small openings 119 accommodate fasteners, and are adapted to align with the small openings 103.

To permit mounting of the box 111 into the interior of the panel assembly, there is provided a plate or sheetlike template 104 which is typically of heavy paper, cardboard or thin plastic. This template is preferably configured similar to a rectangular picture frame and has a generally rectangular opening 106 extending therethrough, which opening is sized so as to substantially equal the vertical cross section of the box 111. The template 104 is positioned adjacent the fabric covering on the side of the panel assembly so that one edge 105 of the template is aligned with the selected vertical panel edge, with the upper edge of the template being positioned a predetermined distance "X" or "Y" from the bottom of the panel assembly depending upon whether the porting box 111 is to be associated with either the upper or lower opening set 101. The template 104 is then temporarily secured to the side of the panel, such as by use of tape. When so secured, the edge 107 of the opening in the template is substantially aligned with the back wall 20 of the adjacent edge rail 17.

Thereafter the installer cuts the underlying fabric as exposed through the template opening 106, which cutting is generally done using a conventional utility knife. The fabric is preferably cut along the diagonal lines 108. Thereafter the cut fabric flaps are pulled outwardly through the template opening 106 and then folded backwardly over the template and temporarily secured, as by being taped, so as to expose the underlying fiberglass layer.

Using the utility knife, the installer then cuts an opening in the underlying fiberglass layer corresponding to the template opening 106, and thereafter cuts a corresponding opening in the underlying fiberboard sheet 26 corresponding in size to the template opening 106. The cut fiberglass and fiberboard are removed and disposed of. The installer also cuts away the underlying honeycomb layer and removes the cut material so as to result in formation of a boxlike opening or recess which opens inwardly from one side of the panel, with the bottom of this opening being closed by the fiberboard sheet 26 provided on the other side of the panel. This opening, in vertical cross section, substantially corresponds to the template opening 106 and is bounded on one side thereof by the base wall 20 of the edge rail 17.

After the template 104 is removed from the panel, then the cut fabric flaps are folded inwardly along the sides of the opening, although excess fabric will typically be cut off of the vertical flap which projects inwardly over the base wall 20 so as to not obstruct the openings 102 and 103. The box 111 is then aligned with the opening and inserted therein until the back wall of the box 111 substantially abuts the opposite fiberboard sheet 26, which results in the front edge of the box being substantially flush with the front side of the panel. During insertion of the box 111 into the opening, the grippers 121 provided on the exterior sidewalls of the box, adjacent the front edge thereof, grip the cut fabric flaps so as to pull them snugly into the opening to maintain proper tension on the fabric around the opening. When so positioned, the openings 102 and 103 are disposed directly adjacent and substantially aligned with the respective openings 118 and 119. Suitable fasteners such as self-tapping screws 122 are then inserted into the openings 119 from interiorly of the box and, with a suitable tool, are threadedly engaged into the openings 103 so as to fixedly secure the box 111 to the adjacent rail 17.

Thereafter a suitable electrical or communication cable can be feed vertically through the channel 31 of the adjacent edge rail 17, and then an end of the cable can be fed through the aligned openings 102 and 118 so as to be accessible within the interior of the box 111. Any suitable electrical or communication port can then be connected to the accessible end of the cable. For this purpose, a cover plate 124 is provided and the latter mounts thereon a suitable electrical port such as a receptacle 126, or a conventional communication port such as a telephone jack 127, or any other type of conventional electrical or communication port. The port is connected in a conventional manner to the accessible end of the cabling located in the box. The cover plate 124 is then positioned so as to overlie and close off the open front of the box 111, and for this purpose the cover plate is fixedly secured to the box by suitable screws 125 which extend through the cover plate and engage the tapped openings formed in the tabs 117. The cover plate 124, as is conventional, has vertical and horizontal face dimensions which are greater than the front dimensions of the box so that the cover plate overlaps the side of the panel in surrounding relationship to the box to provide a totally closed-off finished appearance.

With the improved panel construction provided by the wall system of this invention, the panel assemblies can be fully installed and connected together to define a desired workstation and, after so assembled, decisions can then be more easily made as to where electrical or communication ports are to be located, namely as to what panels, whether the port is to be located adjacent the right or left edge of the panel, and whether the port is desired above or below worksurface height. The porting can then be retrofitted onto the panel while the panel is assembled in a workstation arrangement, without requiring any elaborate tools, while resulting in an arrangement which does not detract from the appearance of the panel after the installation has been completed.

It should be noted that the fiberglass layer 30 has been omitted in FIGS. 3, 13, 20, 21 and 22 for convenience in illustration, but such layer 30 is typically provided between the fabric and fiberboard sheets.

Although a particular preferred embodiment of the invention has been disclosed in detail for illustrative purposes, it will be recognized that variations or modifications of the disclosed apparatus, including the configuration and rearrangement of parts, lie within the scope of the present invention.

The embodiments of the invention in which an exclusive property or privilege is claimed are defined as follows:

1. In an interior upright space-dividing wall system having first and second portable upright wall panel assemblies joined in end-to-end relationship, each said wall panel assembly including upright end edges defined at least in part by vertically elongate end members, and an upright support assembly joined to each end edge of each said panel assembly, said support assembly including a foot portion on a lower end thereof adapted for supportive engagement with a floor, and said support assembly including a vertically elongate support member having generally parallel and sidewardly spaced vertically elongate sidewalls each having a plurality of hanger-receiving openings therein, the hanger-receiving openings in each said sidewall being disposed in vertically spaced relationship so as to define a generally vertically elongate row, wherein the improvement comprises said support member has pluralities of first and second hooks fixed thereon and respectively defining first and second vertically-extending rows which are horizontally spaced apart, said first and second hooks being substantially identical and projecting in horizontal cantilevered relationship from said support member in opposite and outward directions relative to one another, each said end member having a plurality of hook-receiving slots formed therein and disposed in vertically spaced relationship along a vertically extending row, said first hooks of a first said support assembly projecting into said slots of the end member of said first panel assembly for directly fixedly but releasably connecting said first panel assembly to said support assembly.

2. A system according to claim 1, wherein said support member includes a generally imperforate intermediate wall which has opposite edges thereof rigidly and fixedly joined to the respective sidewalls with said intermediate wall being disposed between the sidewalls so that the hanger openings in one said sidewall are effectively isolated from the hanger openings in the opposite sidewall.

3. A system according to claim 1, wherein said support member is of a generally Z-shaped cross section and includes a cross wall which extends diagonally between and is fixedly and rigidly joined to opposite edges of the sidewalls, said cross wall being imperforate so as to isolate the hanger-receiving openings in one sidewall from the hanger-receiving openings in the other sidewall, each sidewall having a free edge which is remote from the edge to which the cross wall is joined, said first hooks being integral with and projecting horizontally outwardly from the free edge of a first said sidewall, said second hooks being integral with and projecting outwardly from the free edge of the second said sidewall.

4. A system according to claim 3, wherein said first and second hooks are each of generally T-shaped vertical configuration and include a base portion which projects horizontally from the sidewall and which terminates in a vertically projecting head portion having upper and lower hook parts which are respectively cantilevered upwardly and downwardly from the base portion.

5. A system according to claim 3, wherein said second hooks project through and are engaged within the slots formed in the end member of the second panel assembly for creating a direct rigid but separable connection therewith, said first and second panel assemblies defining channels extending vertically along the end edges thereof and spaced inwardly from vertical side surfaces of the panel assemblies so that the support member is effectively confined within the opposed channels when the support member is rigidly joined to the first and second panel assemblies, said panel assemblies having end surfaces spaced a small horizontal distance apart so as to define a narrow vertically elongate gap therebetween which aligns with the row of hanger-receiving openings in the sidewalls of the support member.

6. A system according to claim 3, wherein the support member includes pluralities of third and fourth hooks which are vertically spaced apart and respectively disposed within horizontally spaced rows which extend in generally parallel relationship vertically along the support member, said third and fourth hooks being cantilevered horizontally so as to project outwardly away from one another in opposite directions, said third and fourth hooks being joined to and projecting outwardly away from the other side edge of the first and second sidewalls respectively, whereby said first and third hooks are generally vertically coplanar and project horizontally outwardly away from one another in opposite directions, and said second and fourth hooks are generally vertically coplanar and project horizontally outwardly away from one another in opposite directions.

7. A system according to claim 6, wherein each said end member has two vertically extending rows of said hook-receiving slots formed therein in sidewardly spaced relationship, the slots of said two rows respectively receiving therein said first and third hooks for fixedly but releasably joining said first panel assembly to said support member.

8. A system according to claim 1, wherein said first and second panel assemblies are disposed in generally perpendicularly relationship to one another and respectively have first and second said end edges which are disposed in closely adjacent relationship to one another to define a corner, said first support assembly being fixedly and directly connected to the end member of said first end edge by said first hooks, a second said support assembly which is identical to said first support assembly, said second support assembly having said first hooks thereon directly engaged with the end member of said second end edge, and a vertically elongate corner member for fixedly but releasably coupling said first and second support assemblies together, said corner member having two rows of vertically-spaced openings formed therein in horizontally sidewardly spaced relationship with said two rows of openings being elongate vertically, and said second hooks as associated with each of said first and second support assemblies being fixedly and directly engaged with one of the rows of openings in the corner member.

9. A system according to claim 8, wherein said second hooks have downwardly cantilevered hook parts which engage the openings in the corner member for limiting upward movement of the corner member relative to the support assemblies, and said corner member being free of direct vertical support with the floor.

10. A system according to claim 8, including alignment means cooperating between said corner member and said first and second support assemblies for maintaining vertical alignment between said first and second panel assemblies, said alignment means permitting transfer of vertical loads from one said support assembly through said corner member to the other said support assembly.

11. A system according to claim 10, wherein said alignment means incudes a pair of alignment members provided on said corner member and defining a horizontally outwardly opening slot therebetween, one alignment member of said pair being fixed to the corner member and the other alignment member of the pair being relatively vertically movable, each said support assembly having an alignment element fixed thereto and projecting horizontally outwardly for engagement between the alignment members of the corner member, and adjustment means associated with the movable alignment member for fixedly but releasably clamping the alignment elements on the support assemblies between the pair of alignment members.

12. In an interior upright space-dividing wall system having first and second portable upright wall panel assemblies joined in end-to-end relationship, said first and second panel assemblies respectively having first and second vertically elongate end edges disposed in closely adjacent relationship with said first and second panel assemblies projecting in generally perpendicular relationship to one another, and first and second identical support post assemblies respectively cooperating with said first and second end edges, each said support post assembly having a foot portion on a lower end thereof adapted for supportive engagement with a floor, the improvement comprising first hook-and-slot means cooperating directly between said first support post assembly and said first end edge for creating a fixed but releasable connection of said first post assembly to said first panel assembly, second hook-and-slot means cooperating between said second post assembly and said second end edge for creating a fixed but releasable connection of said second panel assembly to said second post assembly, a vertically elongate corner connector positioned closely adjacent and generally between said first and second post assemblies, said corner connector being free of direct supportive engagement with the floor, third hook-and-slot means cooperating directly between said corner connector and said first support post assembly for creating a fixed but releasable connection therebetween, and fourth hook-and-slots means cooperating directly between said corner connector and said second post assembly for creating a fixed but releasable connection therebetween.

13. A system according to claim 12, including alignment means cooperating between said corner connector and said first and second support post assemblies for maintaining vertical alignment between said first and second panel assemblies, said alignment means permitting transfer of vertical loads from one support post assembly through said corner connector to the other support post assembly.

14. A system according to claim 13, wherein said alignment means includes a pair of vertically spaced alignment plates provided on said corner connector and defining a horizontally opening slot therebetween, one alignment plate of said pair being fixed to the corner connector and the other alignment plate of the pair being vertically movable, each said support post assembly having an alignment member fixed thereto and projected horizontally outwardly for engagement between the alignment plates of the corner connector, and means associated with the movable alignment plate for fixedly but releasably securing the alignment members on the support post assemblies between the pair of alignment plates.

15. A system according to claim 12, wherein said first, second, third and fourth hook-and-slot means respectively include pluralities of first, second, third and fourth hooks, said first and third hooks being fixedly associated with said first support post assembly, said second and fourth hooks being fixedly associated with said second support post assembly, each of said first and second end edges having pluralities of slots therein which respectively cooperate with said first and second hooks, and said corner connector having pluralities of slots therein which cooperate with said second and third hooks.

16. A system according to claim 12, wherein each of said first and second hook-and-slot means includes two sidewardly-spaced vertically extending rows of hooks fixed to the respective support post assembly and engaged within two sidewardly-spaced vertically extending rows of slots provided in the respective vertical end edge of the respective panel assembly, each of said third and fourth hook-and-slot means including two sidewardly-spaced vertically extending rows of hooks fixedly associated with the respective support post assembly with only a single one of said latter rows of hooks being engaged within a single row of slots as provided on and extending vertically of the corner connector.

17. A system according to claim 16, wherein said corner connector is of a generally L-shaped horizontal cross section, and wherein each said support post assembly includes a vertically elongate support member which is of a generally Z-shaped horizontal cross section and has said hooks fixed thereon.

18. A system according to claim 17, including alignment means cooperating between said corner connector and said first and second support post assemblies for maintaining vertical alignment between said first and second panel assemblies, said alignment means permitting transfer of vertical loads from one support post assembly through said corner connector to the other support post assembly.

19. A system according to claim 18, wherein the support member includes generally parallel sidewalls joined by an intermediate cross wall extending generally diagonally therebetween so as to define the generally Z-shaped horizontal cross section, said intermediate cross wall being imperforated to create a sound barrier, the two rows of hooks as associated with each of said first and second hook-and-slot means being fixed to and projecting outwardly from vertical edges of said sidewalls, and each said sidewall having a vertically extending row of vertically-spaced hanger-receiving openings extending therethrough with direct sound communication between the hanger-receiving openings in the opposed sidewalls being interrupted by said intermediate cross wall.

20. A system according to claim 16, including a third panel assembly disposed generally in horizontal alignment with said first panel assembly and defining thereon a third end edge which is disposed adjacent and in opposed relationship to said first end edge, a third support post assembly which is identical to said first and second support post assemblies being positioned adjacent and cooperating with said third end edge, fifth hook-and-slot means cooperating between third end edge and said third support post assembly for fixedly but releasably coupling said third support post assembly to said third panel assembly, said fifth hook-and-slot means being identical to said first hook-and-slot means, a second corner connector identical to said first-mentioned corner connector and positioned adjacent and coupled between said second and third support post assemblies, and sixth hook-and-slot means cooperating between said second corner and said third support post assembly for fixedly but releasably joining same directly together, said sixth hook-and-slot means being identical to each of said third and fourth hook-and-slot means, and said second corner connector having a second row of slots therein engaged with the remaining row of hooks provided on said second support post assembly and defining part of said fourth hook-and-slot means.

21. In an interior upright space-dividing wall system having at least first and second portable upright panel assemblies joined in aligned end-to-end relationship, said first and second wall panel assemblies respectively having first and second upright end edges disposed in directly adjacent and opposed relationship, said end edges each defining therein a vertically elongate channel which extends substantially throughout the vertical height of the panel assembly and opens horizontally inwardly of the respective end edge with said channel being spaced inwardly from opposite side surfaces of the respective panel assembly, and a vertically elongate support post assembly positioned within and extending vertically along the opposed channels defined in said opposed first and second end edges with said support post assembly being fixedly coupled to each of said first and second panel assemblies, said support post assembly having a support foot provided on a lower end thereof and adapted for direct supportive engagement with a floor, wherein the improvement comprises said support post assembly includes a vertically elongate support post which is of a generally Z-shaped horizontal cross section having generally parallel and sidewardly spaced first and second side legs joined by an intermediate leg which extends transversely between and is fixedly joined to the parallel side legs, said side legs and said intermediate leg all being vertically elongate and extending throughout a majority of the height of the panel assemblies, each said side leg having a plurality of vertically spaced and vertically elongate hanger-receiving openings formed horizontally therethrough with the openings in each side leg being substantially vertically aligned along a generally vertically extending row, said intermediate leg being substantially of imperforate construction to create a sound barrier between the openings in the opposed side legs, the row of openings in each side leg being accessible for receiving hangers associated with accessories which mount adjacent said panel assemblies, the opposed end edges having opposed end surfaces which are spaced horizontally a small distance apart to define a narrow vertically extending gap therebetween which is aligned with the adjacent row of openings to provide access thereto by the hangers.

22. A system according to claim 21, wherein each of said first and second side legs has first and second vertically extending side edges disposed adjacent the first and second end edges respectively, said intermediate leg extending between and being fixedly adjoined to said first sidewall adjacent the edge thereof and to said second sidewall adjacent the second side edge thereof, the second side edge of said first sidewall being free and having a plurality of first hooks projecting horizontally therefrom in cantilevered relationship and being engaged within slots defined in said first end edge, and the first side edge of said second sidewall being free and having a plurality of second hooks projecting horizontally therefrom and being engageable within slots formed in said second end edge, each plurality of hooks and the associated slots being disposed in vertically spaced relationship along a generally vertically extending row.

23. A system according to claim 21, wherein each of said first and second side legs has first and second vertically extending side edges disposed adjacent the first and second end edges respectively, said intermediate wall extending between and being fixedly adjoined to said first sidewall adjacent the first side edge thereof and to said second sidewall adjacent the second side edge thereof, the second side edges of said first and second sidewalls having pluralities of first hooks projecting horizontally therefrom in cantilevered relationship and being engaged within slots defined in said first end edge, and the first side edges of said first and second sidewalls having pluralities of second hooks projecting horizontally therefrom and being engaged within slots formed in said second end edge, each plurality of hooks and the associated slots being disposed in vertically spaced relationship along a generally vertically extending row.

24. A system according to claim 1, wherein said second hooks project through and are engaged within the slots formed in the end member of the second panel assembly for creating a direct rigid but separable connection therewith.

* * * * *